US008740329B2

(12) United States Patent
Yamaguchi et al.

(10) Patent No.: US 8,740,329 B2
(45) Date of Patent: Jun. 3, 2014

(54) INKJET PRINTING APPARATUS AND METHOD FOR CONTROLLING DRIVE OF NOZZLES IN INKJET PRINTING APPARATUS

(75) Inventors: Hiromitsu Yamaguchi, Yokohama (JP); Yoshitomo Marumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/193,018

(22) Filed: Jul. 28, 2011

(65) Prior Publication Data

US 2012/0044287 A1 Feb. 23, 2012

(30) Foreign Application Priority Data

Aug. 19, 2010 (JP) ..... 2010-184332

(51) Int. Cl.
*B41J 29/38* (2006.01)

(52) U.S. Cl.
USPC ..... 347/9; 347/5; 347/14

(58) Field of Classification Search
USPC ..... 347/5, 9, 12, 14
See application file for complete search history.

(56) References Cited

U.S. PATENT DOCUMENTS 6,997,533 B2 * 2/2006 Nakajima et al. ..... 347/9
2008/0150979 A1 6/2008 Shibata et al.
2009/0256873 A1 10/2009 Yamaguchi et al.

FOREIGN PATENT DOCUMENTS

JP 7-60968 A 3/1995

* cited by examiner

*Primary Examiner* — Lam S Nguyen
(74) *Attorney, Agent, or Firm* — Fitzpatrick, Cella, Harper & Scinto

(57) ABSTRACT

An inkjet printing apparatus that prints each raster in a multi-pass printing mode by causing a printhead having a plurality of nozzles forming a nozzle array to scan in a direction intersecting with the nozzle array is provided, in which the nozzles are divided into groups, each including adjacent nozzles, one nozzle selected from each group is united into one block, drive of nozzles is controlled such that drive timings of nozzles differ among a plurality of blocks in each group, and a sequence in which nozzles are driven is determined for each scan in the multi-pass printing mode such that printed dots are most equally printed in the raster.

14 Claims, 20 Drawing Sheets

| RASTER | BETWEEN FIRST AND SECOND PIXELS | BETWEEN SECOND AND THIRD PIXELS | BETWEEN THIRD AND FOURTH PIXELS | BETWEEN FOURTH AND FIFTH PIXELS |
|---|---|---|---|---|
| 0 | 5 | 5 | 3 | 3 |
| 1 | 3 | 6 | 5 | 2 |
| 2 | 5 | 2 | 7 | 2 |
| 3 | 3 | 5 | 1 | 7 |
| 4 | 5 | 5 | 3 | 3 |
| 5 | 3 | 6 | 5 | 2 |
| 6 | 5 | 2 | 7 | 2 |
| 7 | 3 | 5 | 1 | 7 |

| RASTER | FIRST SCAN | SECOND SCAN | THIRD SCAN | FOURTH SCAN |
|---|---|---|---|---|
| 0 | BLOCK 0 | BLOCK 0 | BLOCK 0 | BLOCK 0 |
| 1 | BLOCK 1 | BLOCK 1 | BLOCK 1 | BLOCK 1 |
| 2 | BLOCK 2 | BLOCK 2 | BLOCK 2 | BLOCK 2 |
| 3 | BLOCK 3 | BLOCK 3 | BLOCK 3 | BLOCK 3 |
| 4 | BLOCK 0 | BLOCK 0 | BLOCK 0 | BLOCK 0 |
| 5 | BLOCK 1 | BLOCK 1 | BLOCK 1 | BLOCK 1 |
| 6 | BLOCK 2 | BLOCK 2 | BLOCK 2 | BLOCK 2 |
| 7 | BLOCK 3 | BLOCK 3 | BLOCK 3 | BLOCK 3 |

| RASTER | FIRST SCAN | SECOND SCAN | THIRD SCAN | FOURTH SCAN |
|---|---|---|---|---|
| 0 | Bt0 | Bt1 | Bt2 | Bt1 |
| 1 | Bt2 | Bt3 | Bt1 | Bt0 |
| 2 | Bt1 | Bt2 | Bt0 | Bt3 |
| 3 | Bt3 | Bt0 | Bt3 | Bt2 |
| 4 | Bt0 | Bt1 | Bt2 | Bt1 |
| 5 | Bt2 | Bt3 | Bt1 | Bt0 |
| 6 | Bt1 | Bt2 | Bt0 | Bt3 |
| 7 | Bt3 | Bt0 | Bt3 | Bt2 |

| RASTER | BETWEEN FIRST AND SECOND PIXELS | BETWEEN SECOND AND THIRD PIXELS | BETWEEN THIRD AND FOURTH PIXELS | BETWEEN FOURTH AND FIFTH PIXELS |
|---|---|---|---|---|
| 0 | 5 | 5 | 3 | 3 |
| 1 | 3 | 6 | 5 | 2 |
| 2 | 5 | 2 | 7 | 2 |
| 3 | 3 | 5 | 1 | 7 |
| 4 | 5 | 5 | 3 | 3 |
| 5 | 3 | 6 | 5 | 2 |
| 6 | 5 | 2 | 7 | 2 |
| 7 | 3 | 5 | 1 | 7 |

FIG. 10

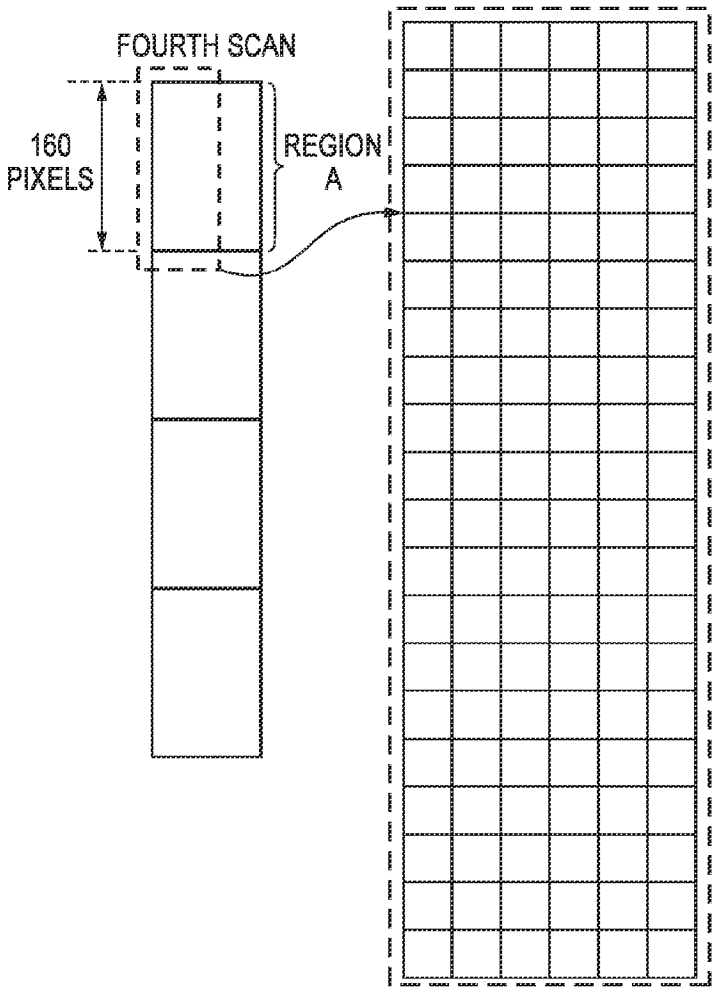

| RASTER | FIRST SCAN | SECOND SCAN | THIRD SCAN | FOURTH SCAN |
|---|---|---|---|---|
| 0 | BLOCK 0 | BLOCK 0 | BLOCK 0 | BLOCK 0 |
| 1 | BLOCK 1 | BLOCK 1 | BLOCK 1 | BLOCK 1 |
| 2 | BLOCK 2 | BLOCK 2 | BLOCK 2 | BLOCK 2 |
| 3 | BLOCK 3 | BLOCK 3 | BLOCK 3 | BLOCK 3 |
| 4 | BLOCK 4 | BLOCK 4 | BLOCK 4 | BLOCK 4 |
| 5 | BLOCK 5 | BLOCK 5 | BLOCK 5 | BLOCK 5 |
| 6 | BLOCK 6 | BLOCK 6 | BLOCK 6 | BLOCK 6 |
| 7 | BLOCK 7 | BLOCK 7 | BLOCK 7 | BLOCK 7 |
| 8 | BLOCK 8 | BLOCK 8 | BLOCK 8 | BLOCK 8 |
| 9 | BLOCK 9 | BLOCK 9 | BLOCK 9 | BLOCK 9 |
| 10 | BLOCK 10 | BLOCK 10 | BLOCK 10 | BLOCK 10 |
| 11 | BLOCK 11 | BLOCK 11 | BLOCK 11 | BLOCK 11 |
| 12 | BLOCK 12 | BLOCK 12 | BLOCK 12 | BLOCK 12 |
| 13 | BLOCK 13 | BLOCK 13 | BLOCK 13 | BLOCK 13 |
| 14 | BLOCK 14 | BLOCK 14 | BLOCK 14 | BLOCK 14 |
| 15 | BLOCK 15 | BLOCK 15 | BLOCK 15 | BLOCK 15 |
| 16 | BLOCK 16 | BLOCK 16 | BLOCK 16 | BLOCK 16 |
| 17 | BLOCK 17 | BLOCK 17 | BLOCK 17 | BLOCK 17 |
| 18 | BLOCK 18 | BLOCK 18 | BLOCK 18 | BLOCK 18 |
| 19 | BLOCK 19 | BLOCK 19 | BLOCK 19 | BLOCK 19 |

| RASTER | FIRST SCAN | SECOND SCAN | THIRD SCAN | FOURTH SCAN |
|---|---|---|---|---|
| 0 | Bt0 | Bt5 | Bt10 | Bt15 |
| 1 | Bt1 | Bt6 | Bt11 | Bt16 |
| 2 | Bt2 | Bt7 | Bt12 | Bt17 |
| 3 | Bt3 | Bt8 | Bt13 | Bt18 |
| 4 | Bt4 | Bt9 | Bt14 | Bt19 |
| 5 | Bt5 | Bt10 | Bt15 | Bt0 |
| 6 | Bt6 | Bt11 | Bt16 | Bt1 |
| 7 | Bt7 | Bt12 | Bt17 | Bt2 |
| 8 | Bt8 | Bt13 | Bt18 | Bt3 |
| 9 | Bt9 | Bt14 | Bt19 | Bt4 |
| 10 | Bt10 | Bt15 | Bt0 | Bt5 |
| 11 | Bt11 | Bt16 | Bt1 | Bt6 |
| 12 | Bt12 | Bt17 | Bt2 | Bt7 |
| 13 | Bt13 | Bt18 | Bt3 | Bt8 |
| 14 | Bt14 | Bt19 | Bt4 | Bt9 |
| 15 | Bt15 | Bt0 | Bt5 | Bt10 |
| 16 | Bt16 | Bt1 | Bt6 | Bt11 |
| 17 | Bt17 | Bt2 | Bt7 | Bt12 |
| 18 | Bt18 | Bt3 | Bt8 | Bt13 |
| 19 | Bt19 | Bt4 | Bt9 | Bt14 |

FIG. 13

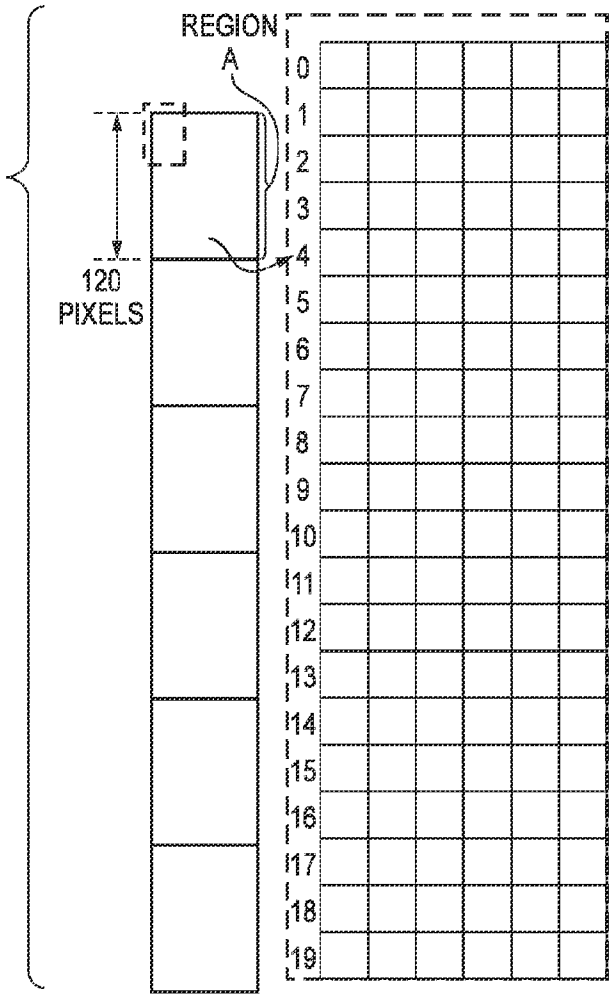

| RASTER | FIRST SCAN | SECOND SCAN | THIRD SCAN | FOURTH SCAN | FIFTH SCAN | SIXTH SCAN |
|---|---|---|---|---|---|---|
| 0 | BLOCK 0 | BLOCK 0 | BLOCK 0 | BLOCK 0 | BLOCK 0 | BLOCK 0 |
| 1 | BLOCK 1 | BLOCK 1 | BLOCK 1 | BLOCK 1 | BLOCK 1 | BLOCK 1 |
| 2 | BLOCK 2 | BLOCK 2 | BLOCK 2 | BLOCK 2 | BLOCK 2 | BLOCK 2 |
| 3 | BLOCK 3 | BLOCK 3 | BLOCK 3 | BLOCK 3 | BLOCK 3 | BLOCK 3 |
| 4 | BLOCK 4 | BLOCK 4 | BLOCK 4 | BLOCK 4 | BLOCK 4 | BLOCK 4 |
| 5 | BLOCK 5 | BLOCK 5 | BLOCK 5 | BLOCK 5 | BLOCK 5 | BLOCK 5 |
| 6 | BLOCK 6 | BLOCK 6 | BLOCK 6 | BLOCK 6 | BLOCK 6 | BLOCK 6 |
| 7 | BLOCK 7 | BLOCK 7 | BLOCK 7 | BLOCK 7 | BLOCK 7 | BLOCK 7 |
| 8 | BLOCK 8 | BLOCK 8 | BLOCK 8 | BLOCK 8 | BLOCK 8 | BLOCK 8 |
| 9 | BLOCK 9 | BLOCK 9 | BLOCK 9 | BLOCK 9 | BLOCK 9 | BLOCK 9 |
| 10 | BLOCK 10 | BLOCK 10 | BLOCK 10 | BLOCK 10 | BLOCK 10 | BLOCK 10 |
| 11 | BLOCK 11 | BLOCK 11 | BLOCK 11 | BLOCK 11 | BLOCK 11 | BLOCK 11 |
| 12 | BLOCK 12 | BLOCK 12 | BLOCK 12 | BLOCK 12 | BLOCK 12 | BLOCK 12 |
| 13 | BLOCK 13 | BLOCK 13 | BLOCK 13 | BLOCK 13 | BLOCK 13 | BLOCK 13 |
| 14 | BLOCK 14 | BLOCK 14 | BLOCK 14 | BLOCK 14 | BLOCK 14 | BLOCK 14 |
| 15 | BLOCK 15 | BLOCK 15 | BLOCK 15 | BLOCK 15 | BLOCK 15 | BLOCK 15 |
| 16 | BLOCK 16 | BLOCK 16 | BLOCK 16 | BLOCK 16 | BLOCK 16 | BLOCK 16 |
| 17 | BLOCK 17 | BLOCK 17 | BLOCK 17 | BLOCK 17 | BLOCK 17 | BLOCK 17 |
| 18 | BLOCK 18 | BLOCK 18 | BLOCK 18 | BLOCK 18 | BLOCK 18 | BLOCK 18 |
| 19 | BLOCK 19 | BLOCK 19 | BLOCK 19 | BLOCK 19 | BLOCK 19 | BLOCK 19 |

FIG. 15A

| RASTER | FIRST SCAN | SECOND SCAN | THIRD SCAN | FOURTH SCAN | FIFTH SCAN | SIXTH SCAN |
|---|---|---|---|---|---|---|
| 0 | Bt0 | Bt3 | Bt6 | Bt10 | Bt13 | Bt16 |
| 1 | Bt1 | Bt4 | Bt7 | Bt11 | Bt14 | Bt17 |
| 2 | Bt2 | Bt5 | Bt8 | Bt12 | Bt15 | Bt18 |
| 3 | Bt3 | Bt6 | Bt9 | Bt13 | Bt16 | Bt19 |
| 4 | Bt4 | Bt7 | Bt10 | Bt14 | Bt17 | Bt0 |
| 5 | Bt5 | Bt8 | Bt11 | Bt15 | Bt18 | Bt1 |
| 6 | Bt6 | Bt9 | Bt12 | Bt16 | Bt19 | Bt2 |
| 7 | Bt7 | Bt10 | Bt13 | Bt17 | Bt0 | Bt3 |
| 8 | Bt8 | Bt11 | Bt14 | Bt18 | Bt1 | Bt4 |
| 9 | Bt9 | Bt12 | Bt15 | Bt19 | Bt2 | Bt5 |
| 10 | Bt10 | Bt13 | Bt16 | Bt0 | Bt3 | Bt6 |
| 11 | Bt11 | Bt14 | Bt17 | Bt1 | Bt4 | Bt7 |
| 12 | Bt12 | Bt15 | Bt18 | Bt2 | Bt5 | Bt8 |
| 13 | Bt13 | Bt16 | Bt19 | Bt3 | Bt6 | Bt9 |
| 14 | Bt14 | Bt17 | Bt0 | Bt4 | Bt7 | Bt10 |
| 15 | Bt15 | Bt18 | Bt1 | Bt5 | Bt8 | Bt11 |
| 16 | Bt16 | Bt19 | Bt2 | Bt6 | Bt9 | Bt12 |
| 17 | Bt17 | Bt0 | Bt3 | Bt7 | Bt10 | Bt13 |
| 18 | Bt18 | Bt1 | Bt4 | Bt8 | Bt11 | Bt14 |
| 19 | Bt19 | Bt2 | Bt5 | Bt9 | Bt12 | Bt15 |

FIG. 15B

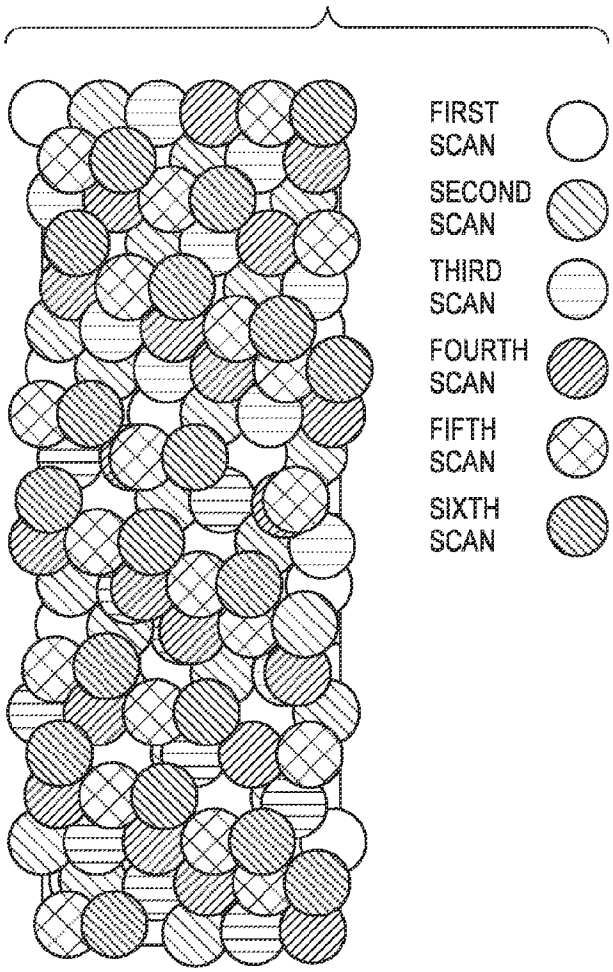

FIG. 17

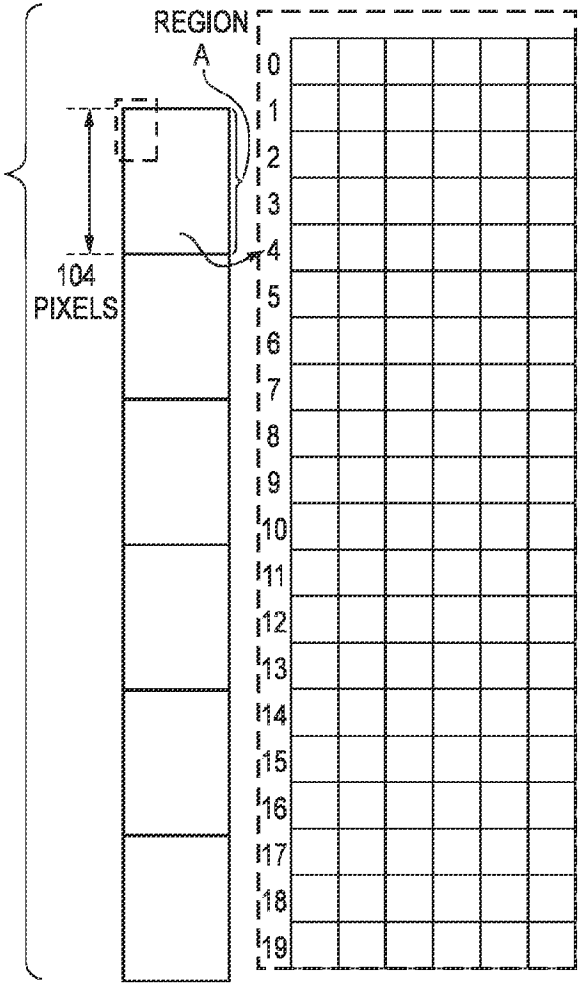

| RASTER | FIRST SCAN | SECOND SCAN | THIRD SCAN | FOURTH SCAN | FIFTH SCAN | SIXTH SCAN |
|---|---|---|---|---|---|---|
| 0 | BLOCK 0 | BLOCK 16 | BLOCK 12 | BLOCK 8 | BLOCK 4 | BLOCK 0 |
| 1 | BLOCK 1 | BLOCK 17 | BLOCK 13 | BLOCK 9 | BLOCK 5 | BLOCK 1 |
| 2 | BLOCK 2 | BLOCK 18 | BLOCK 14 | BLOCK 10 | BLOCK 6 | BLOCK 2 |
| 3 | BLOCK 3 | BLOCK 19 | BLOCK 15 | BLOCK 11 | BLOCK 7 | BLOCK 3 |
| 4 | BLOCK 4 | BLOCK 0 | BLOCK 16 | BLOCK 12 | BLOCK 8 | BLOCK 4 |
| 5 | BLOCK 5 | BLOCK 1 | BLOCK 17 | BLOCK 13 | BLOCK 9 | BLOCK 5 |
| 6 | BLOCK 6 | BLOCK 2 | BLOCK 18 | BLOCK 14 | BLOCK 10 | BLOCK 6 |
| 7 | BLOCK 7 | BLOCK 3 | BLOCK 19 | BLOCK 15 | BLOCK 11 | BLOCK 7 |
| 8 | BLOCK 8 | BLOCK 4 | BLOCK 0 | BLOCK 16 | BLOCK 12 | BLOCK 8 |
| 9 | BLOCK 9 | BLOCK 5 | BLOCK 1 | BLOCK 17 | BLOCK 13 | BLOCK 9 |
| 10 | BLOCK 10 | BLOCK 6 | BLOCK 2 | BLOCK 18 | BLOCK 14 | BLOCK 10 |
| 11 | BLOCK 11 | BLOCK 7 | BLOCK 3 | BLOCK 19 | BLOCK 15 | BLOCK 11 |
| 12 | BLOCK 12 | BLOCK 8 | BLOCK 4 | BLOCK 0 | BLOCK 16 | BLOCK 12 |
| 13 | BLOCK 13 | BLOCK 9 | BLOCK 5 | BLOCK 1 | BLOCK 17 | BLOCK 13 |
| 14 | BLOCK 14 | BLOCK 10 | BLOCK 6 | BLOCK 2 | BLOCK 18 | BLOCK 14 |
| 15 | BLOCK 15 | BLOCK 11 | BLOCK 7 | BLOCK 3 | BLOCK 19 | BLOCK 15 |
| 16 | BLOCK 16 | BLOCK 12 | BLOCK 8 | BLOCK 4 | BLOCK 0 | BLOCK 16 |
| 17 | BLOCK 17 | BLOCK 13 | BLOCK 9 | BLOCK 5 | BLOCK 1 | BLOCK 17 |
| 18 | BLOCK 18 | BLOCK 14 | BLOCK 10 | BLOCK 6 | BLOCK 2 | BLOCK 18 |
| 19 | BLOCK 19 | BLOCK 15 | BLOCK 11 | BLOCK 7 | BLOCK 3 | BLOCK 19 |

FIG. 18A

| RASTER | FIRST SCAN | SECOND SCAN | THIRD SCAN | FOURTH SCAN | FIFTH SCAN | SIXTH SCAN |
|---|---|---|---|---|---|---|
| 0 | Bt0 | Bt4 | Bt8 | Bt12 | Bt16 | Bt2 |
| 1 | Bt1 | Bt5 | Bt9 | Bt13 | Bt17 | Bt3 |
| 2 | Bt2 | Bt6 | Bt10 | Bt14 | Bt18 | Bt4 |
| 3 | Bt3 | Bt7 | Bt11 | Bt15 | Bt19 | Bt5 |
| 4 | Bt4 | Bt8 | Bt12 | Bt16 | Bt0 | Bt6 |
| 5 | Bt5 | Bt9 | Bt13 | Bt17 | Bt1 | Bt7 |
| 6 | Bt6 | Bt10 | Bt14 | Bt18 | Bt2 | Bt8 |
| 7 | Bt7 | Bt11 | Bt15 | Bt19 | Bt3 | Bt9 |
| 8 | Bt8 | Bt12 | Bt16 | Bt0 | Bt4 | Bt10 |
| 9 | Bt9 | Bt13 | Bt17 | Bt1 | Bt5 | Bt11 |
| 10 | Bt10 | Bt14 | Bt18 | Bt2 | Bt6 | Bt12 |
| 11 | Bt11 | Bt15 | Bt19 | Bt3 | Bt7 | Bt13 |
| 12 | Bt12 | Bt16 | Bt0 | Bt4 | Bt8 | Bt14 |
| 13 | Bt13 | Bt17 | Bt1 | Bt5 | Bt9 | Bt15 |
| 14 | Bt14 | Bt18 | Bt2 | Bt6 | Bt10 | Bt16 |
| 15 | Bt15 | Bt19 | Bt3 | Bt7 | Bt11 | Bt17 |
| 16 | Bt16 | Bt0 | Bt4 | Bt8 | Bt12 | Bt18 |
| 17 | Bt17 | Bt1 | Bt5 | Bt9 | Bt13 | Bt19 |
| 18 | Bt18 | Bt2 | Bt6 | Bt10 | Bt14 | Bt0 |
| 19 | Bt19 | Bt3 | Bt7 | Bt11 | Bt15 | Bt1 |

FIG. 18B

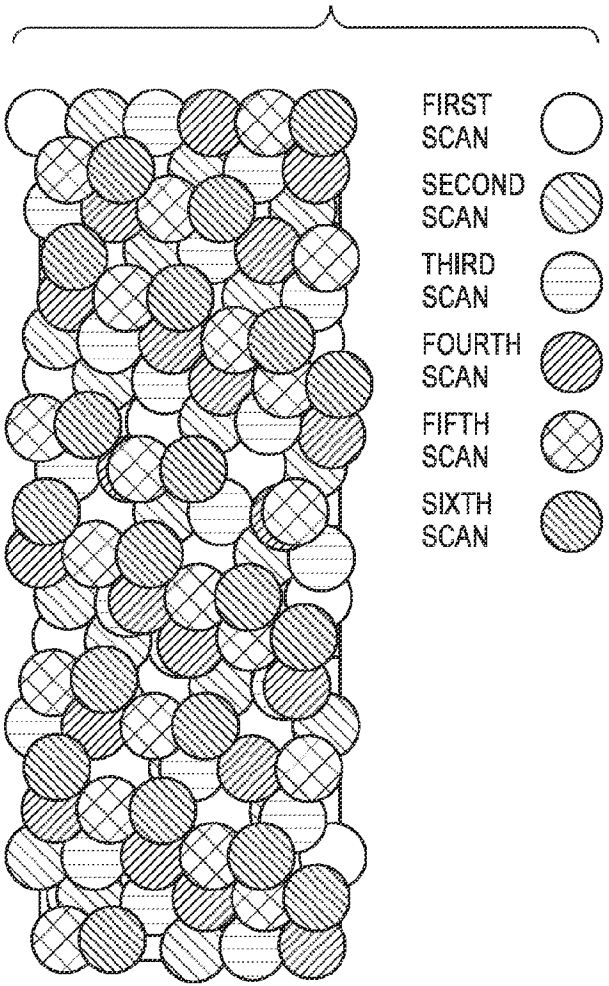

INKJET PRINTING APPARATUS AND METHOD FOR CONTROLLING DRIVE OF NOZZLES IN INKJET PRINTING APPARATUS

BACKGROUND OF THE INVENTION

1. Field of the Invention

The present invention relates to an inkjet printing apparatus that controls drive of nozzles, and a method for controlling drive of nozzles in the inkjet printing apparatus.

2. Description of the Related Art

A printhead of an inkjet printing apparatus includes multiple nozzles (discharge orifices) for discharging ink, each nozzle including an discharge pressure generating element. High-density arrangement of multiple nozzles achieves high image quality and high speed printing. Normally, not all of the nozzles of the inkjet printhead discharge ink droplets at once, and printing is performed while shifting the timing of discharge of ink droplets for each predetermined number of nozzles.

One example of a method for shifting the timing of discharge for each predetermined number of nozzles is that nozzles are divided into sections (groups), each including a predetermined number of nozzles, in accordance with their physical positions in a nozzle array of the inkjet printhead, and in each divided section, drive timings of the discharge pressure generating elements of nozzles are shifted. In order to drive all of the nozzles in each section at different drive timings within a predetermined period of time, each section is divided into multiple drive blocks, and the discharge pressure generating elements per drive block are driven at different times (time-division driving). Note that, in time-division driving performed per drive block, the same drive blocks from each section are driven at the same time, so ink is discharged from one nozzle from each section at once. Such a printhead driving method is referred to as a "separation and division drive system". This separation and division drive system is effective to make compact a power supply for drive of an inkjet printhead, or a power supply member such as a connector or a cable.

In performing printing with such a printhead, the sequence in which blocks are driven has a great influence on the image quality of a printed image. Shifts in drive timings of nozzles to be used appear as shifts in landing positions of ink dots formed on a paper surface. Therefore, clearances are generated, in places of a print area, between ink dots (printed dots) formed on the paper surface, and accordingly a difference arises in the ink coating condition. Such a difference in the ink coating condition leads to degradation of image quality such as uneven density or the presence of streaks.

In view of such problems, Japanese Patent Laid-Open No. 7-60968 discloses a method in which, when an image is printed in multi-pass printing using multiple ink discharge nozzles, the sequence in which the discharge nozzles are driven is varied for each print pass. According to the description of this method, by varying the sequence in which the printhead nozzles are driven depending on the landing diameter or the dot density, it becomes possible to optimize dot placement on a paper surface and to thereby improve the ink coating condition on the paper surface (increase the area factor). In particular, it is possible with this method to obtain high-density and high-image-quality print results on such a print medium as plain paper that greatly suffers from ink spreading.

According to the method described in Japanese Patent Application Laid-Open No. 7-60968, it is actually possible to improve the ink coating condition on such a print medium as plain paper that greatly suffers from ink spreading. However, in the case where output results with high image quality are required with glossy paper or coated paper, it is not possible to achieve sufficient image quality even in multi-pass printing performed by simply changing the sequence in which discharge nozzles are driven, for each print pass. It has also been known that, even if the sequence in which nozzles are driven is varied for each print pass, image quality might deteriorate, depending on the set sequence in which nozzles are driven, due to occurrence of horizontal streaks or uneven density in the horizontal direction. Hence, technology for setting a sequence in which nozzles are driven for each print pass is important because image quality is greatly affected by superfine differences in landing positions due to a difference in the sequence of nozzles to be driven.

SUMMARY OF THE INVENTION

An aspect of the present invention is to eliminate the above-mentioned problems with the conventional technology. The present invention provides an inkjet printing apparatus that achieves high image quality by setting a sequence in which printhead nozzles are driven for each print pass in a multi-pass printing mode, and a method for controlling drive of nozzles in the inkjet printing apparatus.

The present invention in its first aspect provides an inkjet printing apparatus that prints each raster in a multi-pass printing mode by causing a printhead having a plurality of nozzles forming a nozzle array to scan in a direction intersecting with the nozzle array, the apparatus comprising: a drive control unit configured to divide the plurality of nozzles into groups, each including a plurality of adjacent nozzles, unite one nozzle selected from each group into one block, and control drive of nozzles such that drive timings of nozzles differ among a plurality of blocks in each group; and a determination unit configured to determine, for each scan in the multi-pass printing mode, a sequence in which nozzles are driven by the drive control unit, wherein the determination unit determines, for each scan in the multi-pass printing mode, a sequence in which nozzles in a plurality of blocks are driven, such that printed dots corresponding to printing data for a tone are most equally printed in the raster.

The present invention in its second aspect provides a method for controlling drive of nozzles in an inkjet printing apparatus that prints each raster in a multi-pass printing mode by causing a printhead having a plurality of nozzles forming a nozzle array to scan in a direction intersecting with the nozzle array, the method comprising: a drive control step of dividing the plurality of nozzles into groups, each including a plurality of adjacent nozzles, uniting one nozzle selected from each group into one block, and controlling drive of nozzles such that drive timings of nozzles differ among a plurality of blocks in each group; and a determination step of determining, for each scan in the multi-pass printing mode, a sequence in which nozzles are driven by the drive control unit, wherein the determination step determines, for each scan in the multi-pass printing mode, a sequence in which nozzles in a plurality of blocks are driven, such that printed dots corresponding to printing data for a tone are most equally printed in the raster.

According to the present invention, it is possible to achieve high image quality by optimally setting the sequence in which nozzles of a printhead are driven in a multi-pass printing mode.

Further features of the present invention will become apparent from the following description of exemplary embodiments with reference to the attached drawings.

BRIEF DESCRIPTION OF THE DRAWINGS

FIG. 10 is a diagram showing combinations of nozzle blocks according to a first embodiment.

FIG. 13 is a diagram showing combinations of nozzle blocks according to a second embodiment.

FIGS. 15A and 15B are diagrams showing combinations of the block drive timings Bt set for six scans performed on each raster.

FIG. 17 is a diagram showing combinations of nozzle blocks according to a third embodiment.

FIGS. 18A and 18B are diagrams showing combinations of the block drive timings Bt set for six scans performed on each raster.

DESCRIPTION OF THE EMBODIMENTS

Figure 1:
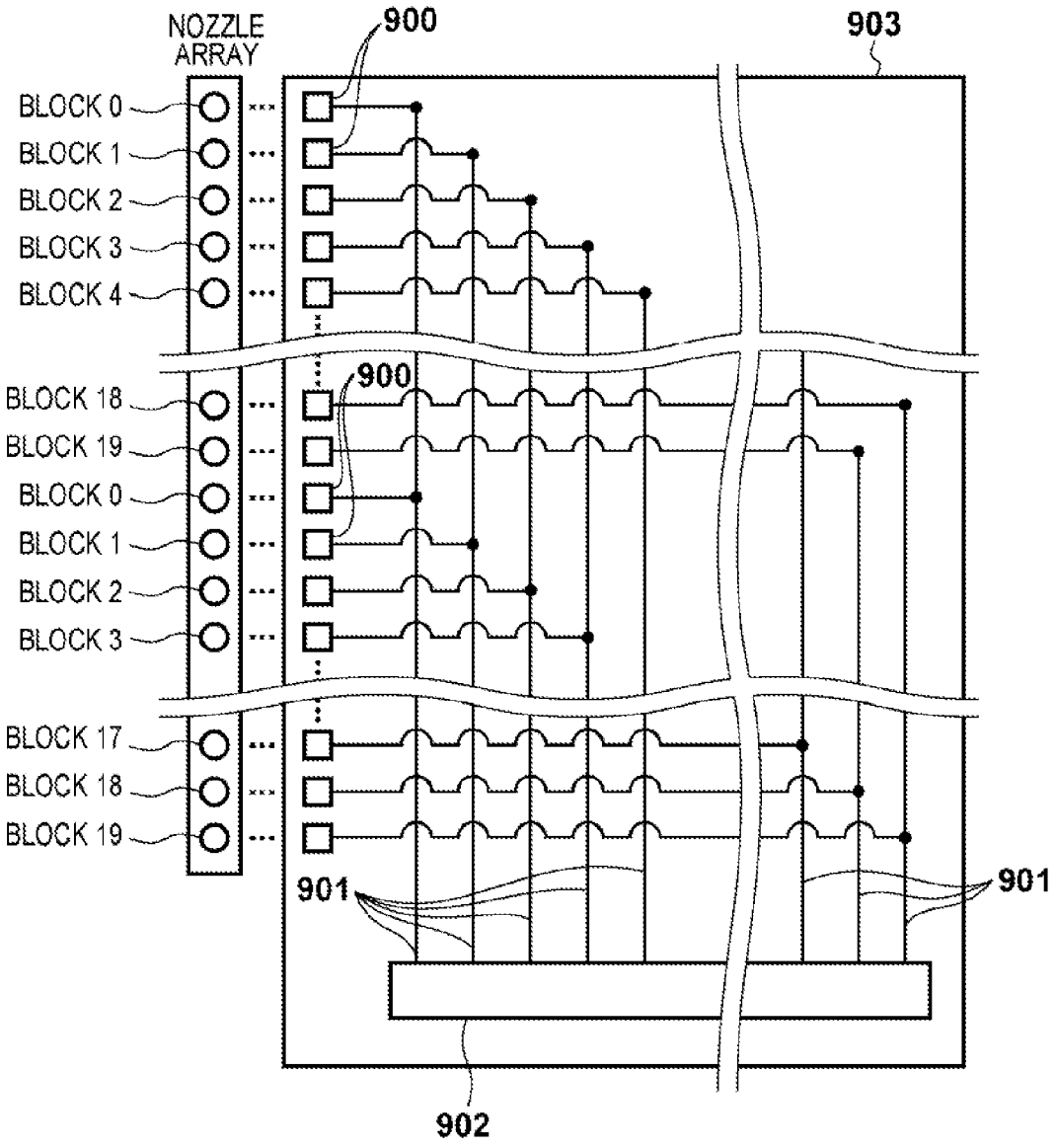
FIG. 1 is a diagram schematically showing a configuration of a printhead used in an embodiment of the present invention.

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention. Note that the same reference numerals have been given to constituent elements that are the same, and redundant descriptions thereof will not be given.

Description of Inkjet Printing Apparatus

Figure 19:
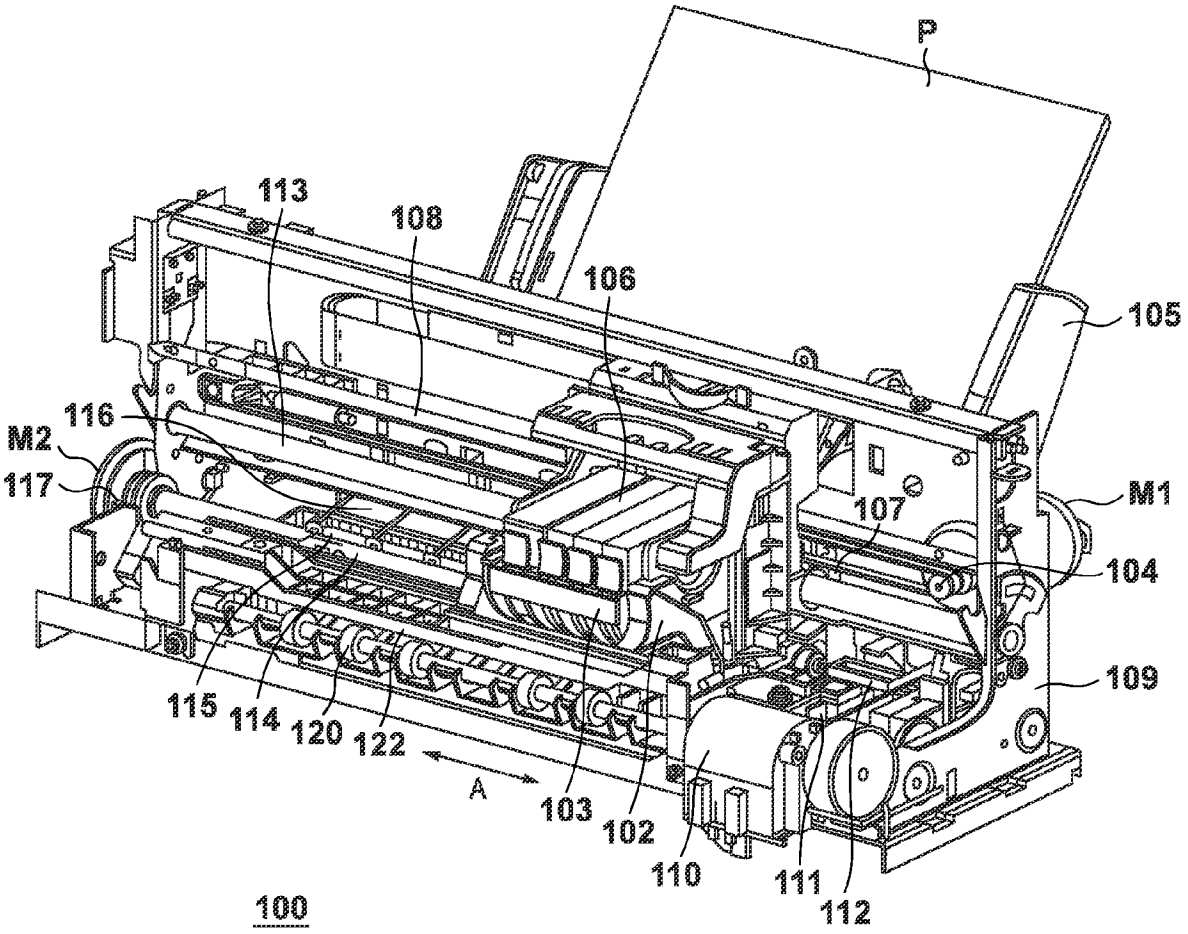
FIG. 19 is a diagram showing an overall configuration of an inkjet printing apparatus.

FIG. 19 is an external perspective view showing an outline of a configuration of an inkjet printing apparatus, which is a typical embodiment of the present invention.

As shown in FIG. 19, the inkjet printing apparatus (hereinafter referred to as the "printing apparatus 100") performs printing such that a transmission mechanism 104 transmits driving force generated by a carriage motor M1 to a carriage 102 so that the carriage 102 moves back and forth in the direction indicated by arrow A, the carriage 102 having mounted thereon a printhead 103 that performs printing by discharging ink in accordance with an inkjet system, and at the same time, a print medium P such as printing paper is supplied via a paper feed mechanism 105 and transported to a printing position, where then the printhead 103 discharges ink onto the print medium P.

Furthermore, in order to maintain the printhead 103 in a good condition, the printing apparatus 100 intermittently performs discharge recovery processing on the printhead 103 by moving the carriage 102 to the position of a recovery apparatus 110.

The carriage 102 of the printing apparatus 100 is equipped with not only the printhead 103, but also ink cartridges 106 containing supply of ink to the printhead 103. The ink cartridges 106 are detachable from the carriage 102.

The printing apparatus 100 shown in FIG. 19 is capable of performing color printing, and therefore the carriage 102 is provided with four ink cartridges that respectively contain magenta (M), cyan (C), yellow (Y), and black (K) ink. These four ink cartridges are independently removable.

The carriage 102 and the printhead 103 are configured to establish and maintain required electrical connection therebetween with their bonding surfaces in proper contact with each other. With application of energy in accordance with a print signal, the printhead 103 selectively discharges ink from multiple discharge orifices for printing. In particular, the printhead 103 of the present embodiment employs an inkjet system for discharging ink using thermal energy and includes electrothermal energy converters for generating thermal energy, in which electric energy applied to the electrothermal energy converters is converted into thermal energy and applied to ink, and resultant film boiling causes growth or shrinkage of an air bubble and accordingly a change in pressure, which causes the ink to be discharged from the discharge orifices. The electrothermal energy converters are provided in correspondence with the respective discharge orifices, and pulse voltage is applied in accordance with a print signal to corresponding electrothermal energy converters so that ink is discharged from the corresponding discharge orifices.

As shown in FIG. 19, the carriage 102 is coupled to part of a driving belt 107 of the transmission mechanism 104, which transmits driving force of the carriage motor M1, and is slidably guided and supported along a guide shaft 113 in the direction of arrow A. Accordingly, the carriage 102 moves back and forth along the guide shaft 113 with forward and reverse rotation of the carriage motor M1. Furthermore, a scale 108 for indicating the absolute position of the carriage 102 is provided along the travel direction of the carriage 102 (in the direction of arrow A, that is, a direction intersecting with the nozzle array of the present embodiment). In the present embodiment, the scale 108 is a transparent PET film with a black bar printed thereon at required pitches, one end of which is fixed to a chassis 109 and the other end of which is supported by a plate spring (not shown).

The printing apparatus 100 is further provided with a platen (not shown) that faces an discharge orifices surface where the discharge orifices (not shown) of the printhead 103 are formed. Printing is performed across the entire width of the print medium P conveyed on the platen by moving the carriage 102 equipped with the printhead 103 back and forth by the driving force of the carriage motor M1 and at the same time discharging ink while giving a print signal to the printhead 103.

In FIG. 19, reference numeral 114 denotes a conveyance roller that is driven by a conveyance motor M2 in order to carry the print medium P, reference numeral 115 denotes a pinch roller that brings the print medium P into abutment against the conveyance roller 114 with use of a spring (not shown), reference numeral 116 denotes a pinch roller holder that rotatably supports the pinch roller 115, and reference numeral 117 is a conveyance roller gear that is fixed to one end of the conveyance roller 114. The conveyance roller 114 is driven by rotation of the conveyance motor M2 transmitted via an intermediate gear (not shown) to the conveyance roller gear 117.

Furthermore, reference numeral 120 denotes an ejection roller for ejecting the print medium P, on which an image has been formed by the printhead 103, out of the printing apparatus, and the ejection roller 120 is driven by transmitted rotation of the conveyance motor M2. Note that the ejection roller 120 abuts on a spur roller (not shown) that brings the print medium P into press contact therewith using a spring (not shown). Reference numeral 122 denotes a spur holder that rotatably supports the spur roller.

Furthermore, in the printing apparatus 100, as shown in FIG. 19, a recovery apparatus 110 for recovering imperfect discharge of the printhead 103 is disposed at a desired position (for example, a position corresponding to the home position) outside of the range of the reciprocating motion of the carriages 102, on which the printhead 103 is mounted, made for print operations (outside of the print area).

The recovery apparatus 110 includes a capping mechanism 111 for capping the discharge orifice surface of the printhead 103 and a wiping mechanism 112 for cleaning the discharge orifice surface of the printhead 103, and performs discharge recovery processing, such as forcibly discharging ink from the discharge orifices with use of a suction configuration (such as a suction pump) in the recovery apparatus in conjunction with capping of the discharge orifice surface performed by the capping mechanism 111, and thereby removing viscous ink, air bubbles, or the like in ink passageways of the printhead 103.

Furthermore, in a non-print operation or the like, it is possible to protect the printhead 103 and prevent ink from evaporating or drying by capping the discharge orifice surface of the printhead 103 by the capping mechanism 111. On the other hand, the wiping mechanism 112 is located in the vicinity of the capping mechanism 111, and is configured to wipe out ink droplets adhering to the discharge orifice surface of the printhead 103.

The presence of the capping mechanism 111 and the wiping mechanism 112 enables the printhead 103 to be in a normal ink discharge condition.

Configuration for Controlling Inkjet Printing Apparatus

Figure 20:
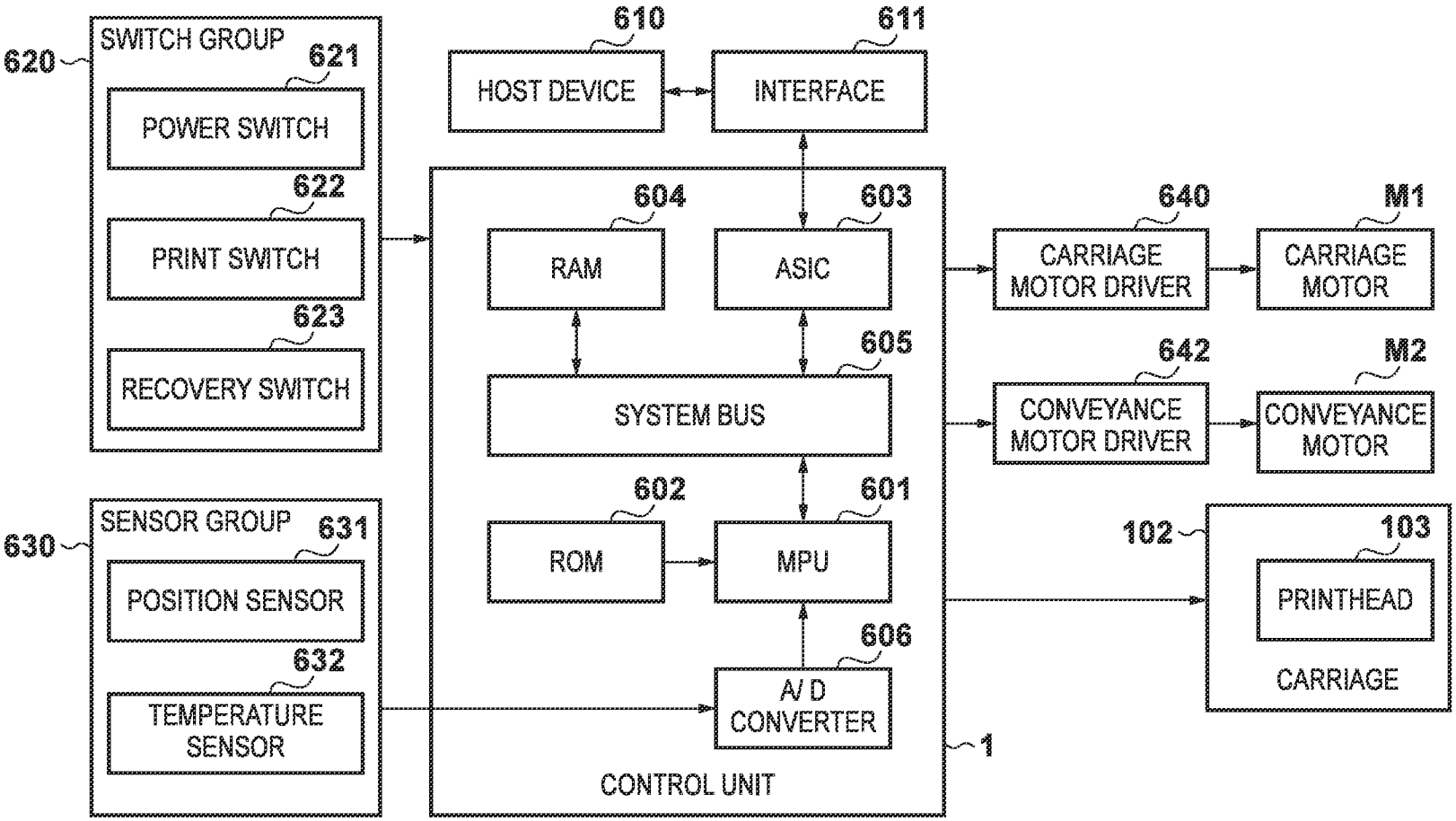
FIG. 20 is a block diagram showing a configuration for controlling the inkjet printing apparatus.

FIG. 20 is a block diagram showing a configuration for controlling the printing apparatus shown in FIG. 19.

As shown in FIG. 20, a control unit 1 includes, for example, an MPU 601, a ROM 602 that stores programs, required tables, and other fixed data that correspond to a control sequence discussed later, a special-purpose integrated circuit (ASIC) 603 that generates control signals for controlling the carriage motor M1, the conveyance motor M2, and the printhead 103, a RAM 604 including, for example, an area for expanding image data and a work area for executing programs, a system bus 605 that interconnects the MPU 601, the ASIC 603, and the RAM 604 for transfer of data, and an A/D converter 606 that receives input of an analog signal from a sensor group discussed below, performs A/D conversion, and supplies a resultant digital signal to the MPU 601. The following procedure of processing according to embodiments discussed below is executed by the control unit 1.

In FIG. 20, reference numeral 610 denotes a computer (or a reader or digital camera for reading of images) serving as a supply source of image data, and it is collectively referred to as a "host device". The host device 610 and the printing apparatus 100 transmit and receive image data, commands, status signals, or the like therebetween via an interface (I/F) 611.

Reference numeral 620 denotes a switch group consisting of switches for receiving input of instructions from an operator, the switch group including a power switch 621, a print switch 622 for giving an instruction to start printing, and a recovery switch 623 for giving an instruction to activate processing (recovery processing) for maintaining the ink discharge performance of the printhead 103 in a good condition. Reference numeral 630 denotes a sensor group for detecting the status of the apparatus, the sensor group including a position sensor 631 such as a photocoupler for detecting the home position h, and a temperature sensor 632 provided in an appropriate place of the printing apparatus in order to detect the environmental temperature.

Furthermore, reference numeral 640 denotes a carriage motor driver that drives the carriage motor M1 for causing the carriage 102 to scan back and forth in the direction of arrow A, and reference numeral 642 denotes a conveyance motor driver that drives the conveyance motor M2 for carrying the print medium P.

In performing a print scan with the printhead 103, the ASIC 603 transfers data (DATA) for driving print elements (ink discharge heater) to the printhead while directly accessing the storage area of the ROM 602.

Note that although the ink cartridges 106 and the printhead 103 are separable in the configuration shown in FIG. 19, a configuration is also possible in which they are integrally formed into a replaceable head cartridge.

The following embodiments include, in particular among inkjet printing systems, a configuration for generating thermal energy as energy used for ink discharge (for example, an electrothermal energy converter or laser beams). The use of such a system that causes a change in the ink condition by thermal energy increases the density and precision of printing.

In addition, the printhead to be used may be not only a cartridge type printhead that is itself integrated with ink tanks, but also a replaceable chip type printhead that is itself installed on the main body of the apparatus and thereby enables electrical connection to the main body of the apparatus and supply of ink from the main body of the apparatus.

Furthermore, the printing apparatus according to the present invention may take a form other than that is integrally or separately provided as an image output terminal of an information processor such as a computer, and for example, it may take a form of a reproducing unit combined with a reader or the like, or a facsimile machine that has transmit/receive functions.

FIG. 1 is a diagram schematically showing a configuration of the printhead used in the present embodiment. The printhead is configured to discharge ink by driving 20 adjacent nozzles at 20 different drive timings. Each nozzle of the printhead is set to one of the 20 drive timings. A group of nozzles that are set at the same drive timing is referred to as a "block", and a timing at which each block is driven is referred to as a "block drive timing Bt". In other words, all of the nozzles are set to one of blocks 0 to 19, and each block is driven at one of block drive timings Bt0 to Bt19. That is, a sequence in which nozzles are driven is controlled among blocks (nozzle drive control). Since at least two or more nozzles are simultaneously driven at one drive timing, the number of nozzles is generally greater than the number of blocks. Furthermore, it is possible to change the sequence of discharge to a desired sequence by changing the sequence of block drive timings Bt set for the 20 blocks.

In FIG. 1, a drive wire 901 is used for transmitting a drive pulse signal. As shown in FIG. 1, energy generation elements 900 corresponding to nozzles to be drived at the same timing mutually connect one drive wire 901. On the other hand, energy generation elements 900 corresponding to nozzles to be drived at the different timing connect different drive wires 901. Therefore, nozzles to be drived at the same timing is able to be set, the order of timing for driving nozzles is also able to be set. As shown in FIG. 1, the drive wire 901 may be arranged on a printing element board 903 of the printing head, and respective drive wires 901 corresponding to respective drive timings may be connected to a decoder 902. The order of driving each of energy generation elements 900 can be changed by a data supply wire (unshown). However, to achieve the same effect, it is not limited to that structure.

Figure 2:
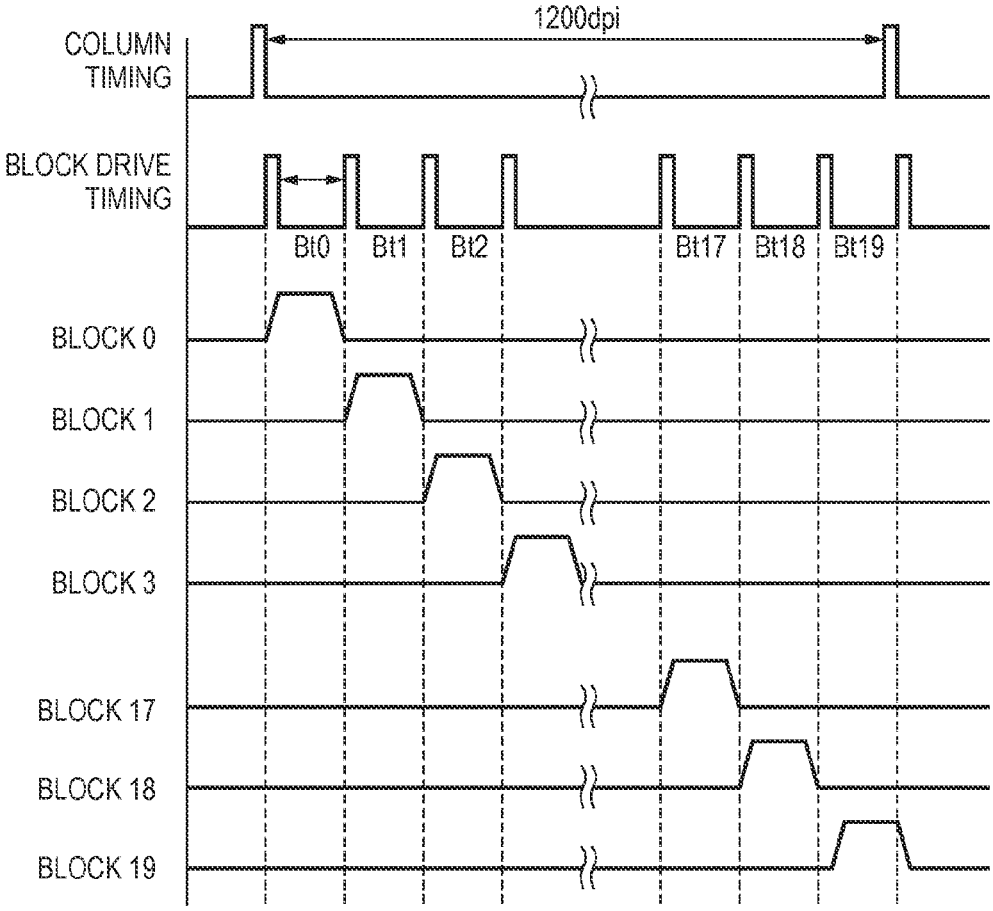
FIG. 2 is a diagram showing an example of a timing chart illustrating block drive timings Bt.

Next is a description of the relationship between blocks and block drive timings Bt. FIG. 2 shows an example of a timing chart showing block numbers and block drive timings Bt in the case where 20 blocks including block 0 to block 19 are driven in sequence for printing at a printing density of 1200 dpi. Here, the term "column timing" refers to a drive signal for discharging ink per pixel at a printing density of 1200 dpi. Since the number of blocks is 20, there are 20 block drive timings Bt within a single column timing interval. The settings of the blocks and the block drive timings Bt are such that block 0 corresponds to Bt0, block 1 corresponds to Bt1, . . . , and block 19 corresponds to Bt19.

Figure 3A:
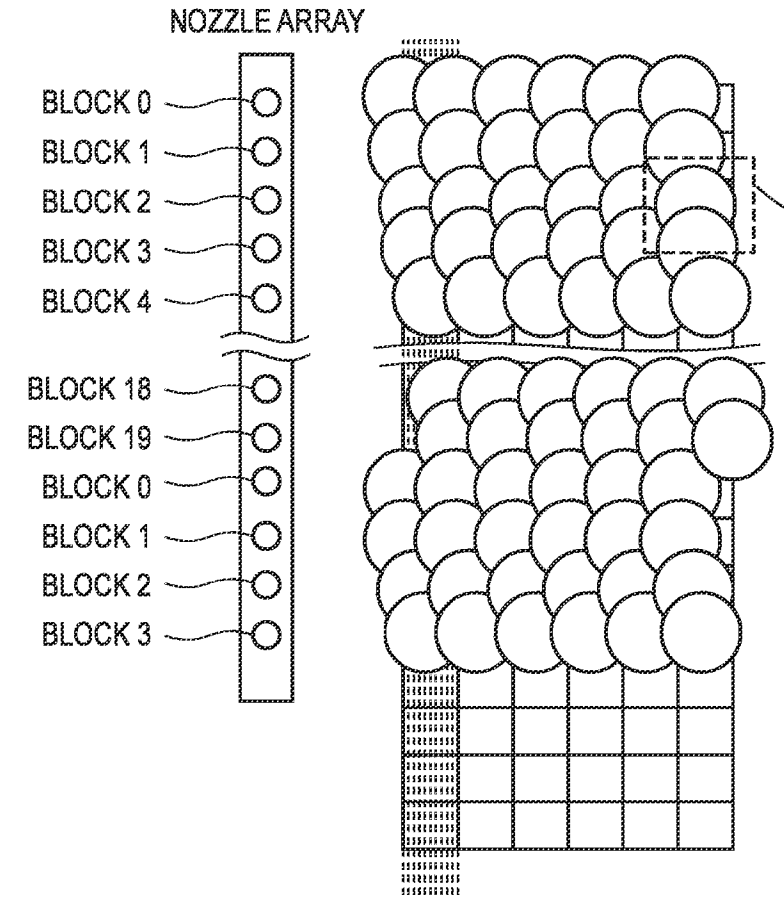
FIGS. 3A and 3B are diagrams showing how ink dots are formed when printing is performed in accordance with FIG. 2.
Figure 3B:
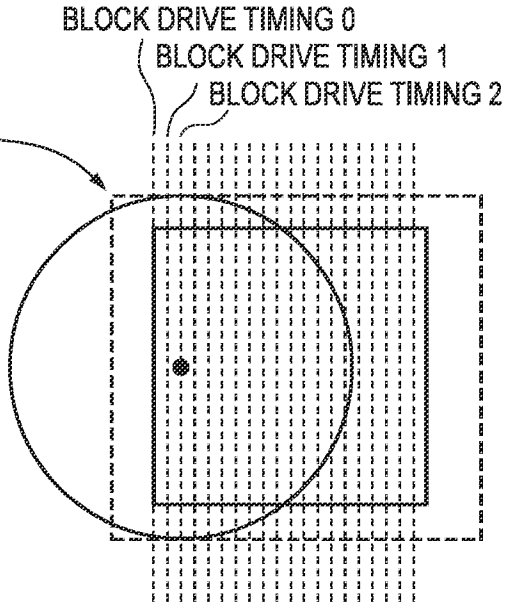

FIGS. 3A and 3B are diagrams schematically showing how ink dots are formed when printing is performed using the printhead in accordance with the drive timings shown in FIG. 2. When the printhead discharges ink on all pixels from each nozzle while moving from the left to the right as viewed in FIG. 3A, ink dots are formed as shown in FIG. 3A. In the present embodiment, such a mesh-like figure showing the positions where ink dots are formed is referred to as a "print matrix". In FIG. 3B, positions where ink dots are discharged from the printhead at the respective block drive timings Bt are indicated by broken lines. Both horizontal and vertical intervals (pitches) of the print matrix correspond to 1200 dpi (approximately 21.2 μm). Shifting the column timing interval by one pitch is equivalent to shifting the landing position of an ink dot by an interval of one dot (approximately 21.2 μm) corresponding to 1200 dpi. As can be seen from FIGS. 3A and 3B, the landing positions of ink dots are shifted, in accordance with the block drive timings Bt of the respective blocks, by amounts corresponding to delay times of the block drive timings Bt.

Figure 4:
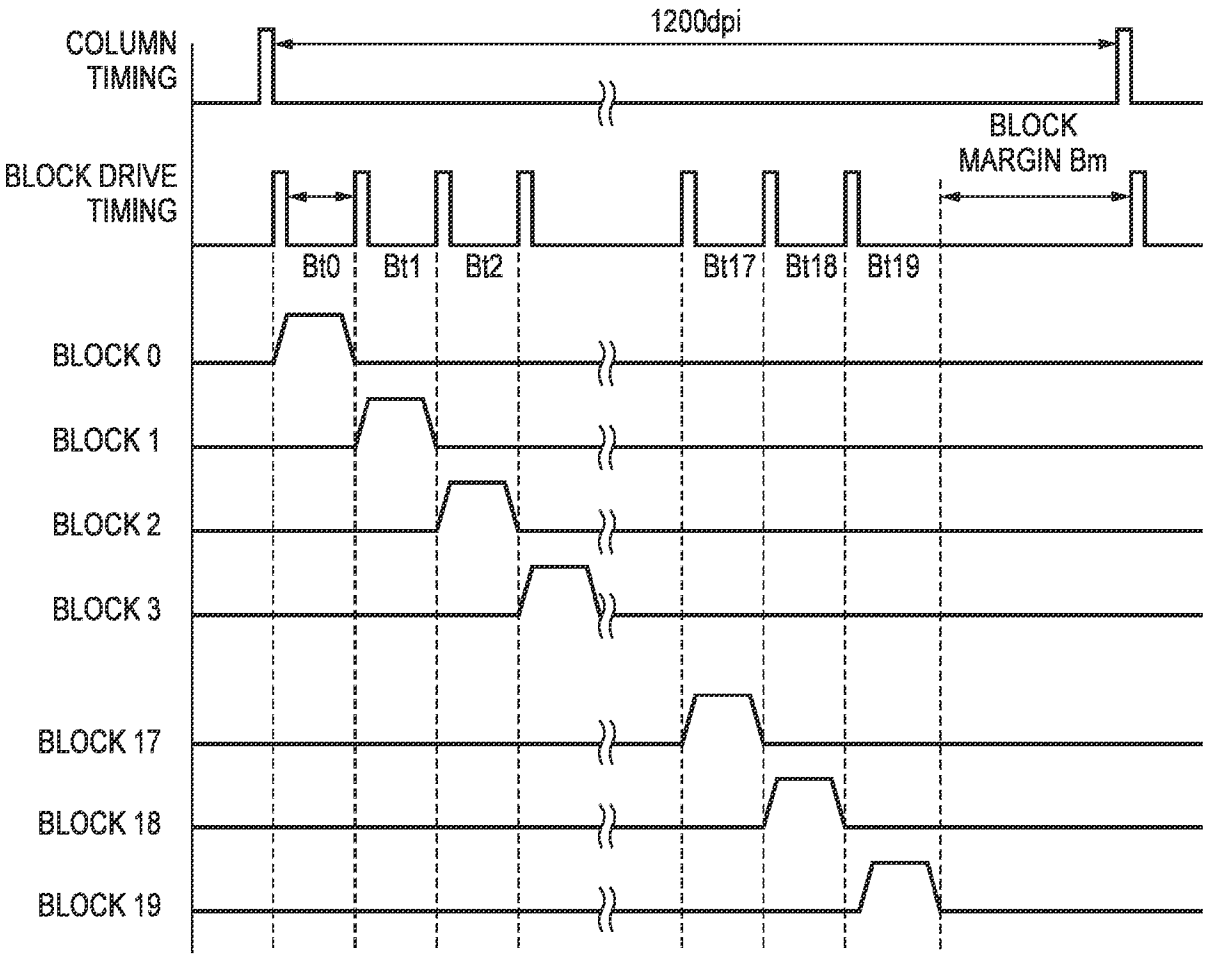
FIG. 4 is a diagram showing another example of the timing chart illustrating the block drive timings Bt.

FIG. 4 shows another example of the timing chart showing block numbers and block drive timings Bt in the case where 20 blocks including block 0 to block 19 are driven in sequence for printing at a printing density of 1200 dpi. What is different from FIG. 2 is that, although there are 20 block drive timings Bt within a single column timing interval, each of the block drive timings Bt is shorter than an interval obtained by dividing the single column timing interval into 20. Accordingly, the block drive timings Bt concentrate in the earlier part of the single column timing interval, and in the later part, there is a time domain where no nozzles are driven. Such a non-driven domain part of the entire one column timing interval is referred to as a "block margin". Although FIG. 4 shows the case where the block margin concentrates in the later part, the block margin may exist in any part of a single column timing interval. Normally, the printer operates while increasing or decreasing each column timing interval during scanning of the printhead, so printing is performed with a shift in timing. Accordingly, the presence of a block margin enables settings such that all block drive timings are included in all of a single column timing interval. The amount of the block margin is desirably set to an optimum minimum value in accordance with an increase or decrease of the column timing intervals that depend on, for example, the precision of moving and scanning of the printer.

Figure 5:
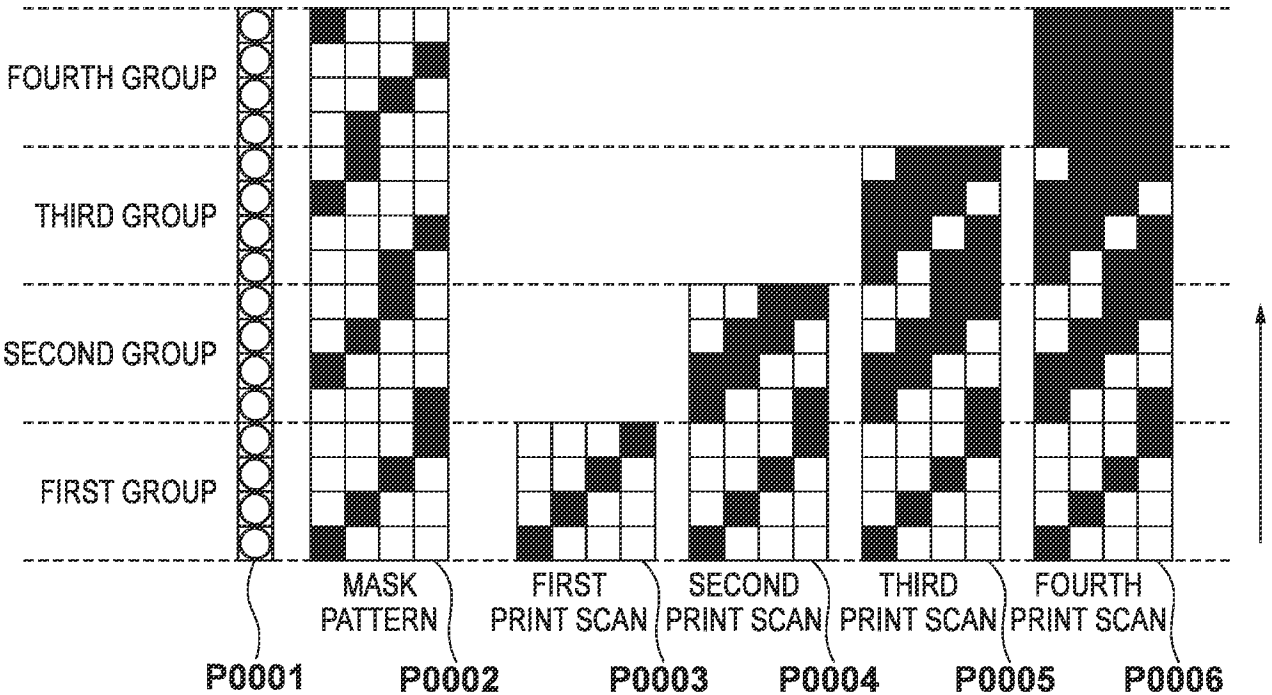
FIG. 5 is a diagram illustrating a mode in which multi-pass printing is completed in four scans.

Next is a description of a multi-pass printing mode performed by the printer of the present embodiment. FIG. 5 is a diagram illustrating, by way of example, a mode in which multi-pass printing is performed in four scans using pass masks, among printing modes performed by the printer of the present embodiment. FIG. 5 schematically shows a printhead, printed dot patterns, and so on in the case where an image to be printed on a unit area is completed in four scans. In FIG. 5, reference character P0001 denotes the printhead. To simplify the drawing and the description, the printhead shown herein has 16 discharge orifices (hereinafter also referred to as "nozzles"). As shown, the nozzle array is divided into four (first to fourth) nozzle groups of four nozzles each for use. Reference character P0002 denotes mask patterns in which pixels in masks that permit printing (print-permitted pixels) are indicated by solid squares in correspondence with the respective nozzles. The mask patterns corresponding to the four nozzle groups are in a complementary relationship with one another, and when these four patterns overlap one another, all 4×4 pixels become print-permitted pixels. In other words, printing of the 4×4 pixel region is completed by the four patterns.

Reference characters P0003 to P0006 denote arrangement patterns of dots to be formed, and show how an image is completed by repeatedly performing print scans. As can be seen from these patterns, in each print scan during multi-pass printing, dots are formed based on binary print data (dot data) generated by the mask patterns corresponding to the respective nozzle groups. Each time after completion of a print scan, the print medium is carried (conveyed) by an amount corresponding to the width of the nozzle groups in the direction of arrow in the drawing. In this way, an image of each region of the print medium that corresponds to the width of the nozzle groups is completed in four print scans.

Next is a description of image quality degradation that has conventionally occurred in the case where the sequence in which nozzles are driven is changed for each scan in multi-pass printing. A printhead to be used in a conventional example is configured as described in FIG. 1 such that the number of nozzles is 64 and the number of blocks, if all of the nozzles are driven, is 4. In other words, a block division frequency Nb is 4. The number of passes Np is 4, that is, a 4-pass printing mode is used. From the relationship with the number of nozzles of the printhead, a feed amount Nf is 16. In this case, the number of passes Np (=4) is the same value as the block division frequency Nb (=4), and the block division frequency Nb is a submultiple of the feed amount Nf (=16). Printing is performed on a region A of a print medium in first to fourth scans using the first to fourth nozzle groups of the printhead. Specifically, pixels along a single raster of the region A are formed by dots discharged from four different nozzles from the respective first to fourth nozzle groups of the printhead.

Figure 6:
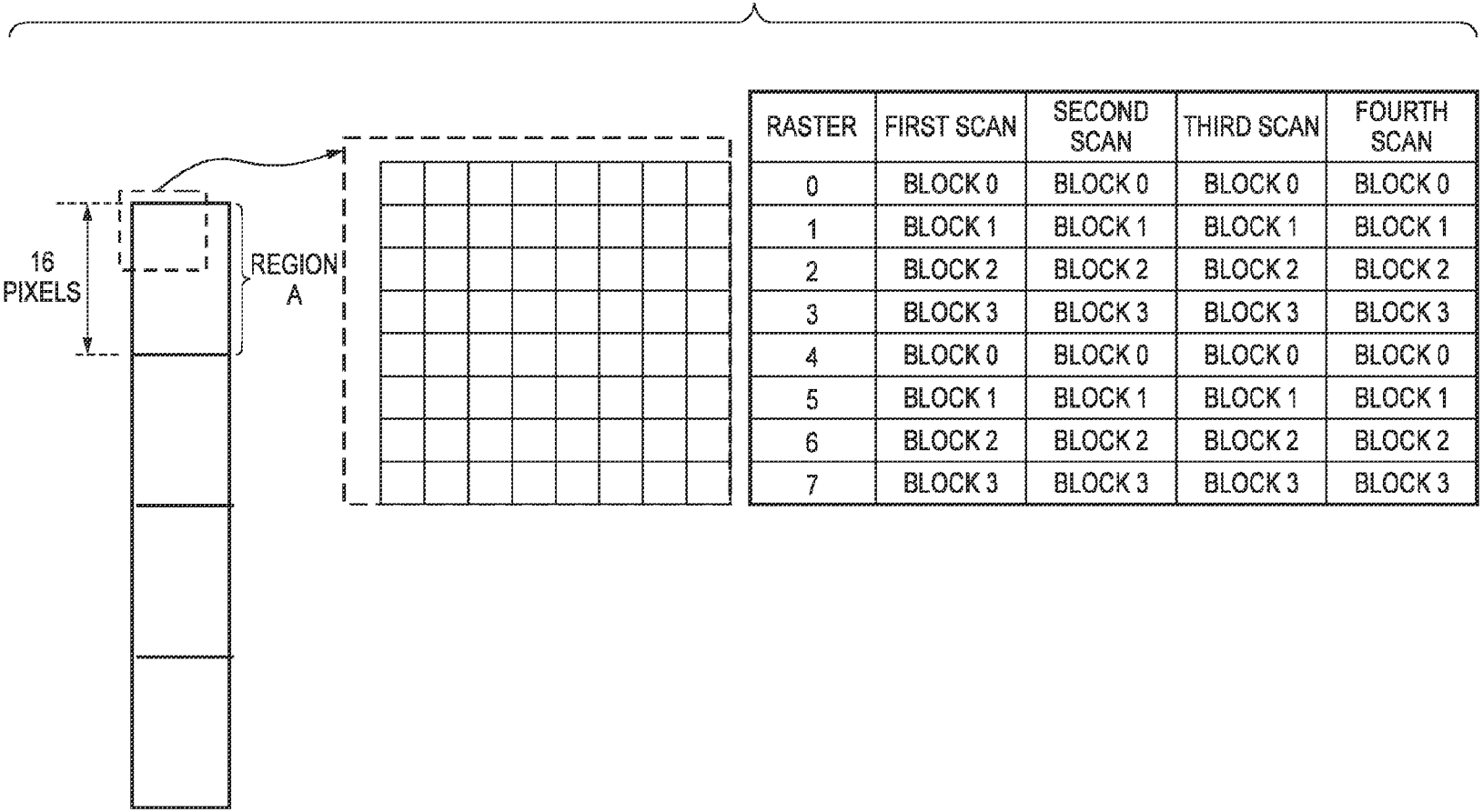
FIG. 6 is a diagram showing combinations of nozzle blocks.

For example, four nozzles including nozzle 48, nozzle 32, nozzle 16, and nozzle 0 are used for printing of the first raster of the region A, namely, raster 0. In this case, all of the four nozzles belong to block 0. This is because the block-division frequency Nb (=4) is divisible by the number of passes (=4), and the feed amount Nf (=16) is divisible by the block division frequency Nb (=4). Similarly, four nozzles including nozzle 49, nozzle 33, nozzle 17, and nozzle 1 are used for raster 1, and all of the four nozzles belong to block 1. FIG. 6 shows combinations of nozzle blocks used for the first eight rasters of the region A. For all of the other rasters, nozzles belonging to the same block are combined. It can be seen from this that the same blocks as used for the first four rasters are repeatedly used for the next four rasters.

Figure 7:
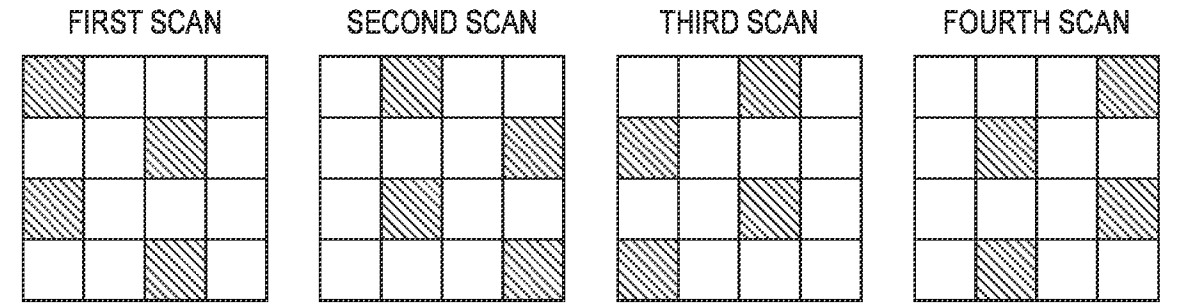
FIG. 7 is a diagram showing mask patterns used for four scans.

Now, consider for example the case where different block drive timings Bt are set for four nozzles in each group used for printing of each of the eight rasters, in all of the four scans. FIG. 7 shows mask patterns of a mask used in four scans during multi-pass printing. Solid squares in each pattern represent print-permitted pixels, that is, discharged dots, whereas hollow squares represent non-permitted pixels. In order to clarify the description, all of the four mask patterns used in the mask used are regular patterns.

Figures 8A, 8B:
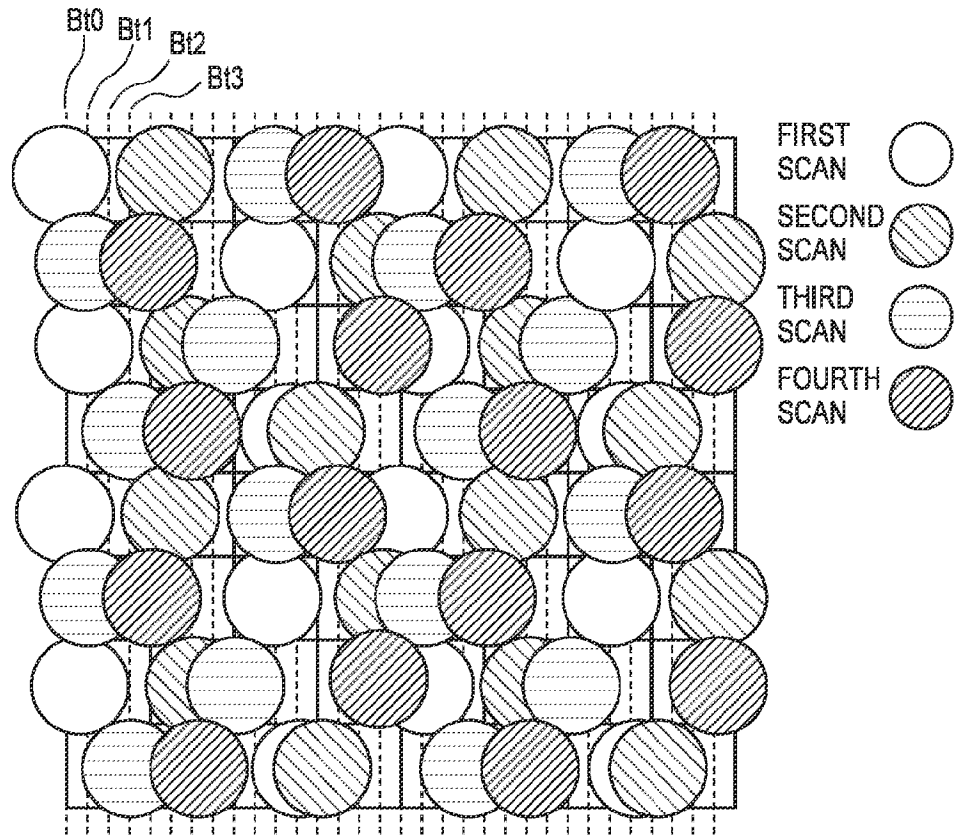
FIGS. 8A and 8B are diagrams showing combinations of the block drive timings Bt set for four scans.

FIG. 8A shows combinations of the block drive timings Bt set for the four scans performed on the eight rasters. FIG. 8B schematically shows how ink dots are formed on a paper surface in the case where an image in which all pixels are filled with ink dots (referred to as a "solid image") is printed by driving nozzles for each raster with the settings of FIG. 8A. As shown in FIG. 8A, different block drive timings Bt are set for the four scans of each raster. Using the aforementioned rasters 0 and 1 as an example, in the case of raster 0, Bt0 is set for the first scan, Bt1 is set for the second scan, Bt2 is set for the third scan, and Bt1 is set for the fourth scan. In the case of raster 1, Bt2 is set for the first scan, Bt3 is set for the second scan, Bt1 is set for the third scan, and Bt0 is set for the fourth scan. Because dots are printed at different drive block timings for each scan, there are regions where dots overlap and regions where dots do not overlap as shown in FIG. 8B. In particular, dots are formed not to overlap one another in raster 0, raster 1, raster 4, and raster 5. On the other hand, dots are formed to overlap one another in raster 2, raster 3, raster 6, and raster 7.

Figures 9A, 9B:
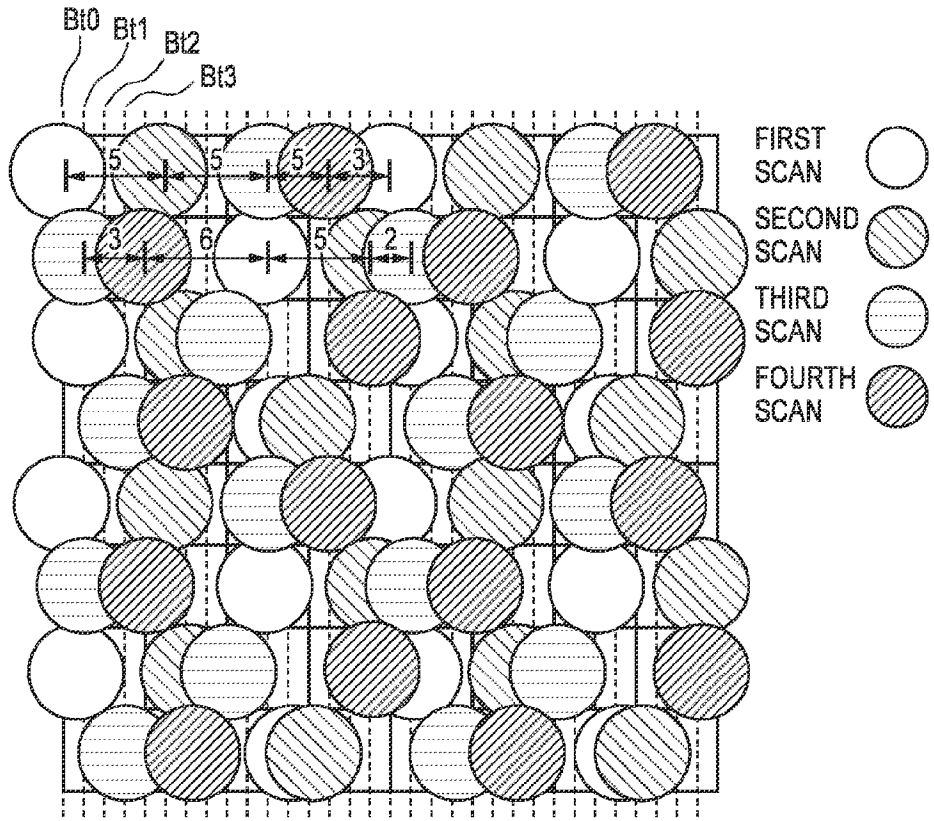
FIGS. 9A and 9B are diagrams showing intervals of the block drive timings Bt between adjacent pixels.

FIGS. 9A and 9B show intervals of the block drive timings Bt between adjacent pixels in the same raster, in the case where the block drive timings Bt are combined as shown in FIG. 8A. For example, in the case of raster 0, Bt0 is set for the first scan, Bt1 is set for the second scan, Bt2 is set for the third scan, and Bt1 is set for the fourth scan. Accordingly, the intervals of the block drive timings Bt between the pixels are, respectively, 5 (=Bt1−Bt0) between the first and second pixels, 5 (=Bt2−Bt1) between the second and third pixels, 3 (=Bt1−Bt2) between the third and fourth pixels, and 3 (=Bt0−Bt1) between the fourth and fifth pixels. In the case of raster 1, the intervals of the block drive timings Bt between pixels are, respectively, 3 (=Bt0−Bt1) between the first and second pixels, 6 (=Bt2−Bt0) between the second and third pixels, 5 (=Bt3−Bt2) between the third and fourth pixels, and 2 (=Bt1−Bt3) between the fourth and fifth pixels. Since there are four block drive timings Bt within a single pixel, an average value of the intervals between adjacent pixels is 4. However, as shown in FIG. 9B, the intervals between pixels vary depending on differences in the block drive timings Bt. The intervals between pixels also differ among rasters.

As shown in FIG. 8B, white patches where no ink is on the paper surface occur in the vicinity of regions where dots overlap one another, and such white patches periodically and repeatedly occur in the horizontal direction that is the scanning direction. Such repeated occurrence of white patches in the horizontal direction is visually recognized as horizontal streaks or uneven density. It has been found from experiments that such differences in the intervals between dots in rasters and differences in the intervals of dots between rasters cause slight changes in the ink coating condition on the paper surface. In particular, when the landing positions of ink dots are shifted, superfine white patches where no ink coating is provided very often occur continuously on the paper surface in the horizontal direction as the scanning direction, and such continuous white patches cause degradation of image quality such as horizontal streaks or unevenness between bands. Therefore, the following is a detailed description of a method for optimally setting the block drive timings for each scan in multi-pass printing, while focusing on very slight changes in the ink coating condition on the paper surface. Embodiments of the present invention aim to reduce white patches in rasters by setting at least different block drive timings for multiple nozzles used for printing of the same raster. A detailed description is thus given of an example where drive timings are set in the case where at least the number of passes is less than or equal to the number of blocks.

First Embodiment

The present embodiment describes the relationship between the number of passes Np in multi-pass printing and the block division frequency Nb determined by the number of blocks, using the case where the number of passes Np is a submultiple of the block division frequency Nb.

A printhead to be used is configured as described in FIG. 1 such that the number of nozzles is 640 and the number of blocks, if all of the nozzles are driven, is 20. In other words, the block division frequency Nb is 20. The number of passes Np is 4, that is, a 4-pass printing mode is used as in the conventional example. Accordingly, the feed amount Nf is 160. In this case, the number of passes Np (=4) is a submultiple of the block division frequency Nb (=20), and the feed amount Nf (=160) is a multiple of the block division frequency.

As in the conventional example, multi-pass printing is also performed on a region A of the print medium in first to fourth scans using first to fourth nozzle groups of the printhead. In this case, four nozzles including nozzle 480, nozzle 320, nozzle 160, and nozzle 0 are used for printing of the first raster of the region A, namely, raster 0. All of these four nozzles belong to block 0. This is because the block division frequency Nb (=20) is divisible by the number of passes (=4), and the feed amount Nf (=160) is divisible by the block division frequency. Similarly, four nozzles including nozzle 481, nozzle 321, nozzle 161, and nozzle 1 are used for raster 1, and all of the four nozzles belong to block 1. FIG. 10 shows combinations of nozzle blocks used for the first 20 rasters of the region A. For all of the other rasters, nozzles belonging to the same block are combined.

Next is a description of a method for setting the block drive timings Bt for such four nozzles used for printing of the same raster performed in four scans. In the present embodiment, different block drive timings Bt are set for each scan. In this case, the block drive timings are set such that, when four block drive timings Bt used for four scans are sorted in ascending order of timings, the timing interval between any two of the block drive timings are equal. Specifically, the block drive timings are set to give a maximum timing interval. Here, assuming that the timing intervals between any two block drive timings Bt are block timing intervals BL, the block drive timings BL are set to be maximum and equal to each other.

Specifically, the block drive timings Bt are set so that the block timing intervals BL set for the four scans become 5 that is the value obtained by dividing the block division frequency Nb (=20) by the number of passes (=4). Using printing of rasters 0 and 1 as an example, in the case of raster 0, Bt0 is set for the first scan, Bt5 is set for the second scan, Bt10 is set for the third scan, and Bt15 is set for the fourth scan. For printing of raster 1, Bt1 is set for the first scan, Bt6 is set for the second scan, Bt11 is set for the third scan, and Bt16 is set for the fourth scan.

Figures 11A, 11B:
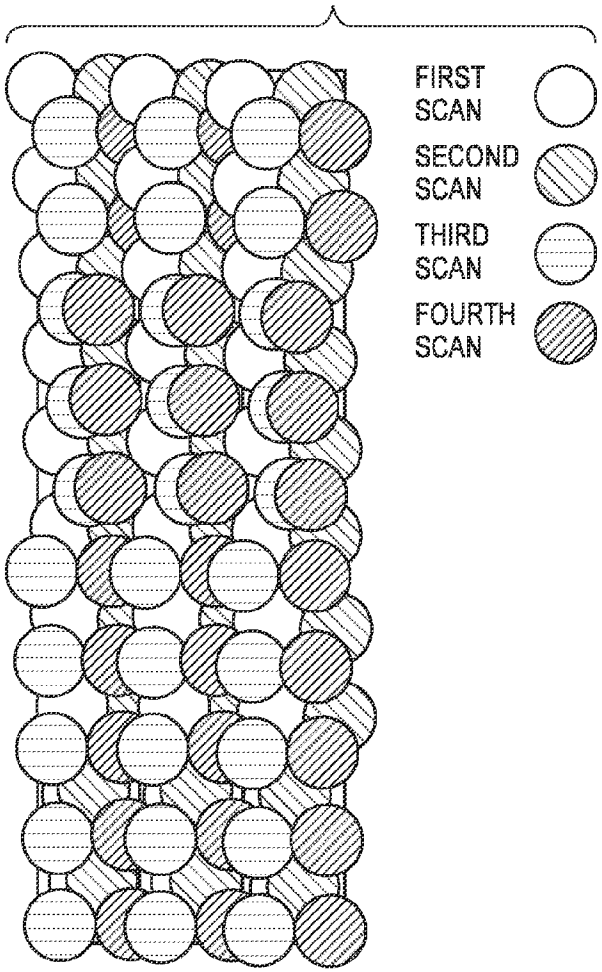
FIGS. 11A and 11B are diagrams showing a case where dots are placed on a single pixel in all four scans.

FIG. 11B is a diagram schematically showing a state in which printed dots are placed on a given pixel of raster 0 in all of the four scans. Normally, printed dots are not placed on the same pixel in all of the four scans, but a description is given of such a case with reference to the drawing in order to facilitate the description. As can be seen from FIG. 11B, printed dots are formed while being shifted in the direction of the raster, so such dot placement is less likely to cause white patches in the horizontal direction. Similarly, for all of the other rasters, settings are made so as to satisfy the above-described intervals. FIG. 11A shows combinations of the block drive timings Bt set for four scans performed on each raster, and FIG. 11B shows how printed dots are formed on the paper surface in the case where printing is performed in accordance with the settings of FIG. 11A. As can be seen from FIG. 11B, overlaps of printed dots are reduced and there are no white patches where ink is not present or no horizontal lines on the paper surface.

The sequence of the block drive timings Bt is not particularly limited, as long as four combinations used for the four scans satisfy the aforementioned block timing intervals BL. For example, in the case of the aforementioned raster 0, the combination may be such that Bt0 is set for the first scan, Bt10 is set for the second scan, Bt5 is set for the third scan, and Bt15 is set for the fourth scan, or that Bt5 is set for the first scan, Bt15 is set for the second scan, Bt0 is set for the third scan, and Bt10 is set for the fourth scan. Furthermore, the sequence of combinations of the block drive timings Bt used for respective rasters is not particularly limited, as long as these combinations satisfy the aforementioned block timing intervals BL. For example, the setting of FIG. 11A may be such that rasters 1 and 5 are interchanged, and rasters 2 and 10 are interchanged. That is, it is possible to use optimum combinations.

Now a generalized method for setting the block drive timings Bt according to the present embodiment will be described. In the case where the block division frequency Nb is divisible by the number of passes Np, if the block drive timings Bt used for Np scans are sorted in ascending order of timings, the timing interval BL determined by any two of the block drive timings Bt is derived from Equation (1) below.

$$\text{Timing Interval BL} = \text{Division Frequency Nb}/\text{Number of Passes Np (where BL is a positive integer)} \quad (1)$$

Specifically, as can be seen from FIGS. 9A and 9B and FIGS. 11A and 11B, the division frequency Nb is a maximum width in the direction of a raster with respect to multiple positions at which a single printed dot can be printed in accordance with drive timing control, and the block timing interval BL is equivalent to a length obtained by dividing the maximum width by the number of passes (the number of scans).

The block drive timings for each scan are set so as to satisfy the timing interval BL obtained from Equation (1). By setting the block drive timings for each scan to satisfy the above-described relationship, it is possible to evenly place printed dots, thus reducing overlaps of the printed dots and preventing white patches where ink is not present from occurring on the paper surface. As a result, horizontal streaks in the direction of a raster or unevenness between bands can be reduced.

Second Embodiment

The present embodiment describes the relationship between the number of passes Np in multi-pass printing and the block division frequency Nb determined by the number of blocks, using the case where the number of passes Np is not a submultiple of the block division frequency Nb and the block division frequency Nb is a submultiple of the feed amount Nf. A printhead to be used in the present embodiment is configured as described in FIG. 1 such that the number of nozzles is 720, the number of blocks is 20, and the block division frequency Nb is 20. The number of passes Np is 6, that is, a 6-pass printing mode is used. From the relationship with the number of nozzles of the printhead, the feed amount Nf is 120. In this case, although the block division frequency Nb (=20) is not divisible by the number of passes Np (=6), the feed amount Nf (=120) is a multiple of the block division frequency Nb (=20).

Figure 12:
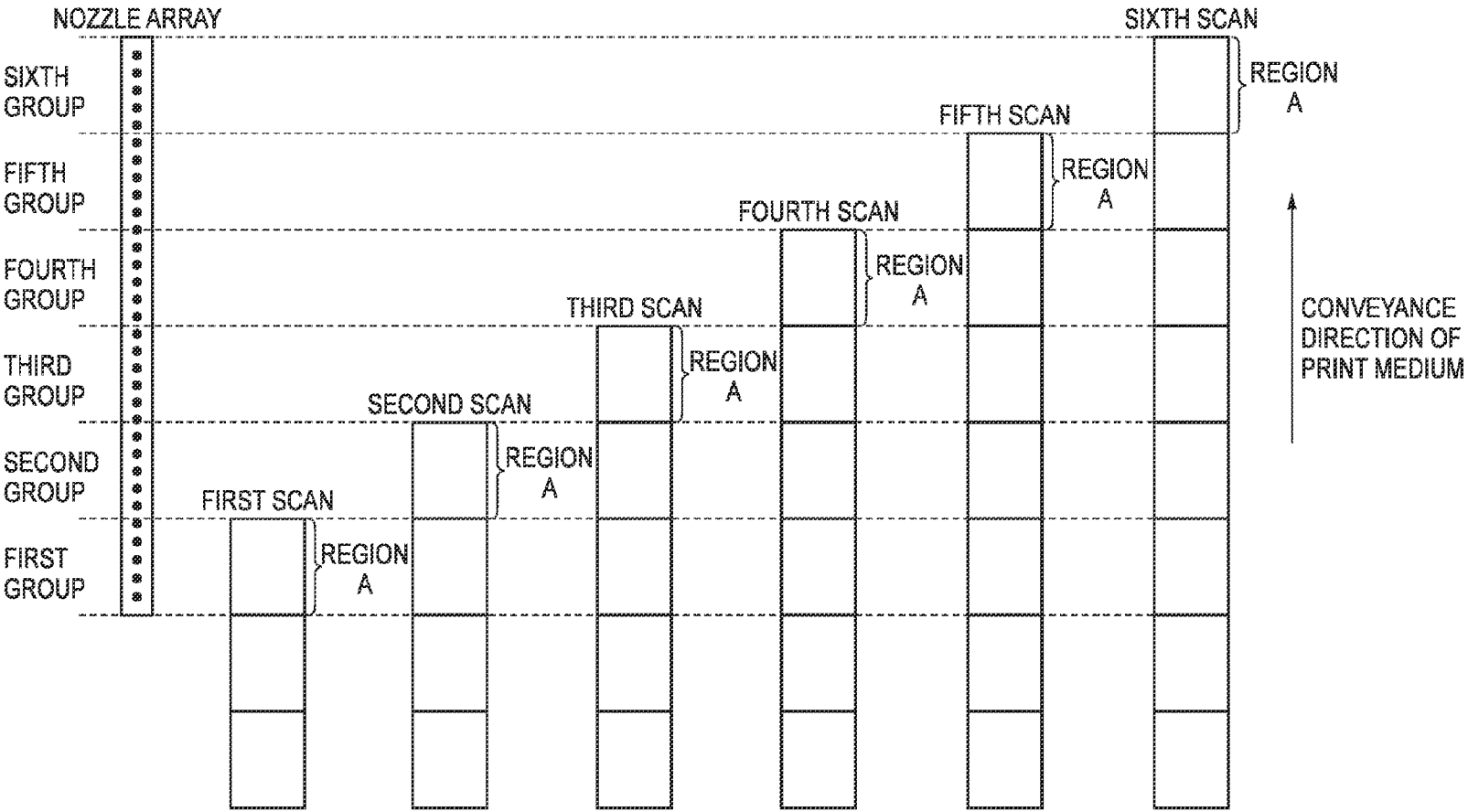
FIG. 12 is a diagram illustrating multi-pass printing completed in six passes.

FIG. 12 is a diagram illustrating multi-pass printing performed in six passes and schematically showing the relationship between the printhead and a print medium. In 6-pass printing, an image to be printed on a predetermined unit region of the print medium is completed in six scans of the printhead. For example, printing is performed on a region A of the print medium in first to sixth scans using first to sixth nozzle groups of the printhead. In this case, after completion of each print scan, the print medium is carried by an amount of 120 pixels that is equivalent to the width of the nozzle groups in the direction of arrow in the drawing. Printing of the image is completed by repeatedly performing this operation.

In this case, pixels in the direction of each raster of the region A are formed by printed dots discharged from six different nozzles from the respective first to sixth nozzle groups of the printhead. For example, six nozzles including nozzle 600, nozzle 480, nozzle 360, nozzle 240, nozzle 120, and nozzle 0 are used for printing of the first raster of the region A, namely, raster 0. In this case, all of these six nozzles belong to block 0. This is because the block division frequency Nb (=20) is a submultiple of the feed amount Nf (=120). Similarly, six nozzles including nozzle 601, nozzle 481, nozzle 361, nozzle 241, nozzle 121, and nozzle 1 are used for raster 1, and all of these six nozzles belong to block 1. FIG. 13 shows combinations of nozzle blocks used for the first 20 rasters of the region A. For all of the other rasters, six nozzles belonging to the same block are combined.

Figure 14:
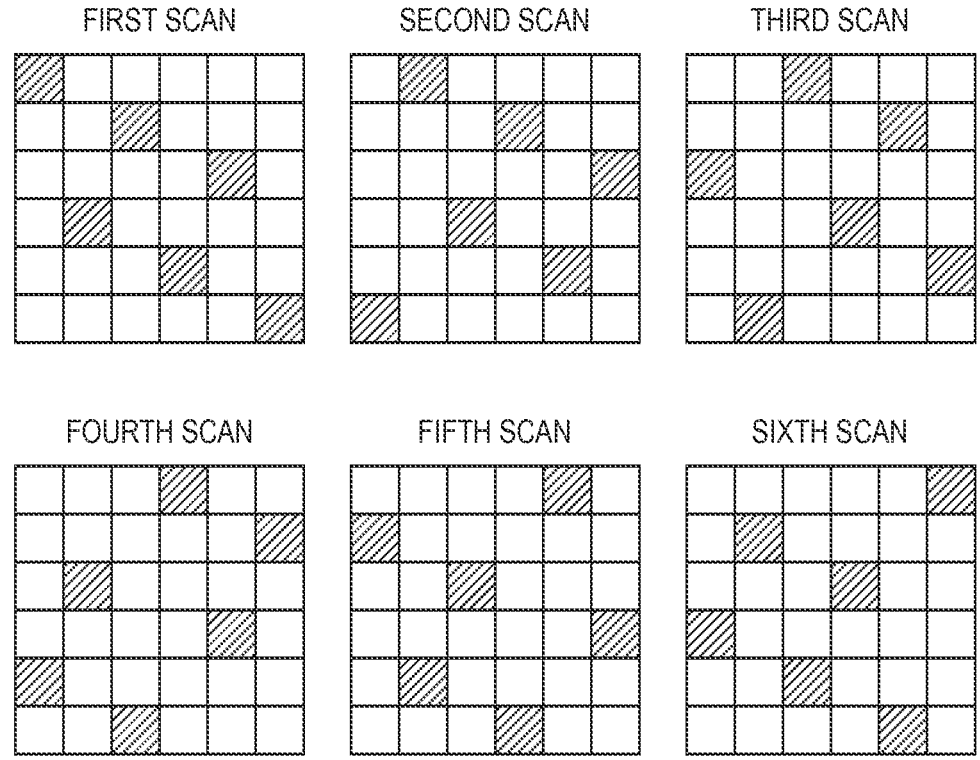
FIG. 14 is a diagram showing mask patterns used for six scans.

FIG. 14 shows mask patterns used for printing performed in six scans. Solid squares in each pattern represent print-permitted pixels, that is, discharged dots, whereas hollow squares represent non-permitted pixels. In order to simplify the description, all of the six mask patterns used in the mask are regular mask patterns. Next is a description of a method for setting the block drive timings Bt set for these six nozzles used for printing of the same raster performed in six scans. In the present embodiment, different block drive timings Bt are set for each scan. In this case, the block drive timings are set such that, when six block drive timings Bt used for six scans are sorted in ascending order of timings, the timing intervals BL between any two of the block drive timings Bt are maximized.

Specifically, the block drive timings Bt are set such that the block timing interval BL between each of the six scans in the direction of a raster is either three or four, the three being the quotient obtained by dividing the block division frequency Nb (=20) by the number of passes (=6), and the four being the value one greater than three. Using printing of raster 0 and 1 as an example, in the case of raster 0, Bt0 is set for the first scan, Bt3 is set for the second scan, Bt6 is set for the third scan, Bt10 is set for the fourth scan, Bt13 is set for the fifth scan, and Bt16 is set for the sixth scan. For printing of raster 1, Bt1 is set for the first scan, Bt4 is set for the second scan, Bt7 is set for the third scan, Bt11 is set for the fourth scan, Bt14 is set for the fifth scan, and Bt17 is set for the sixth scan. Similarly, for all of the other rasters, settings are made so as to satisfy either of the above-described intervals.

FIG. 15A shows combinations of the block drive timings Bt used for six scans performed on each raster, and FIG. 15B shows how printed dots are formed on a paper surface in the case where printing is performed with the settings of FIG. 15A and using mask patterns shown in FIG. 14. As can be seen from FIG. 15B, overlaps of the printed dots are reduced and there are no white patches where ink is not present on the paper surface. The sequence of the block drive timings Bt is not particularly limited, as long as six combinations used for six scans satisfy the aforementioned timing intervals BL. Furthermore, the sequence of combinations of the block drive timings Bt used for respective rasters is not particularly limited, as long as these combinations satisfy the aforementioned timing intervals BL. In either case, it is possible to use optimum combinations.

Now, a generalized method for setting the block drive timings Bt according to the present embodiment will be described. The present embodiment describes the case where the block division frequency Nb is not divisible by the number of passes Np and one of the block division frequency Nb and the feed amount Nf is a multiple of the other, or the case where the block division frequency Nb is not divisible by the number of passes Np and one of the number of passes Np and the feed amount Nf is a multiple of the other. In either case, when the block drive timings Bt used for Np scans are sorted in ascending order of timings, the timing interval BL determined by any two of the block drive timings Bt is derived from Equation (2) below:

$$\text{Timing Interval BL} = \text{Division Frequency Nb}/\text{Number of Paths Np}$$

or $$\text{Timing Interval BL} = (\text{Division Frequency Nb}/\text{Number of Paths Np}) + 1 \text{ (where BL is a positive integer)} \quad (2)$$

The block drive timings for each scan are set to satisfy the timing interval BL obtained from Equation (2). By setting the block drive timings for each scan to satisfy the above-described relationship, it is possible to reduce overlaps of printed dots and to prevent white patches where ink is not present from occurring on the paper surface, thus resulting in a reduction of horizontal streaks in the direction of the raster or unevenness between bands.

Third Embodiment

The present embodiment describes the relationship of the number of passes Np in multi-pass printing, the block division frequency Nb determined by the number of blocks, and the feed amount Nf, using the case where the number of passes Np is not a submultiple of the block division frequency Nb and the block division frequency Nb is not a submultiple of the feed amount Nf.

A printhead to be used in the present embodiment is configured as described in FIG. 1 such that the number of nozzles is 640, the number of blocks is 20, and the block division frequency Nb is 20. The number of passes Np is 6, that is, a 6-pass printing mode is used. Among all of the nozzles of the printhead, the number of nozzles used for printing is 624. Accordingly, there are unused nozzles. The feed amount Nf is 104 from the relationship with the number of nozzles. This value is selected because it is close to the value, 106, that is obtained by dividing 640 nozzles by 6. In this case, the block division frequency Nb (=20) is not divisible by the number of passes Np (=6). The feed amount Nf (=104) is also not divisible by the block division frequency Nb (=20).

Figure 16:
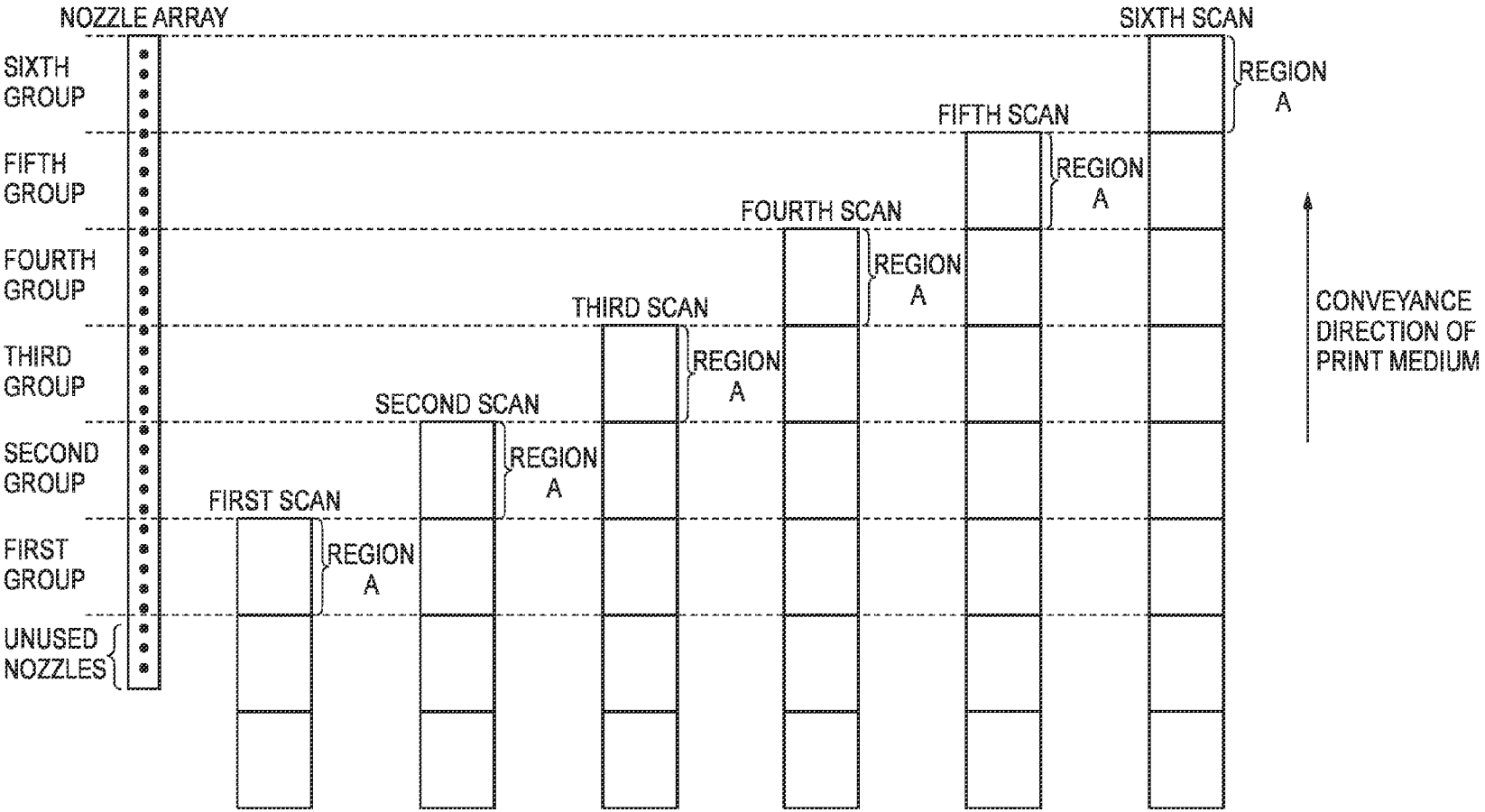
FIG. 16 is a diagram illustrating multi-pass printing completed in six passes.

FIG. 16 is a diagram illustrating multi-pass printing performed in six passes according to the present embodiment and schematically showing the relationship between the printhead and a print medium. Although the method of 6-pass printing is the same as that of the second embodiment, there are some nozzles that are not used for printing in the present case as mentioned above. Accordingly, in the case where printing is performed in six scans using first to sixth nozzle groups, six nozzles including nozzle 520, nozzle 416, nozzle 312, nozzle 208, nozzle 104, and nozzle 0 are used for printing of the first raster of a region A, namely, raster 0. Among the six nozzles, nozzle 520 belongs to block 0, nozzle 416 belongs to block 16, nozzle 312 belongs to block 12, nozzle 208 belongs to block 8, nozzle 104 belongs to block 4, and nozzle 0 belongs to block 0. That is, the nozzles belonging to different blocks are used for the respective scans because the block division frequency Nb (=20) is not a submultiple of the feed amount Nf (=104). It is, however, noted that the nozzles used for the first and sixth scans belong to the same block.

Similarly, six nozzles including nozzle 521, nozzle 417, nozzle 313, nozzle 209, nozzle 105, and nozzle 1 are used for raster 1. In this case, nozzle 521 belongs to block 1, nozzle 417 belongs to block 17, nozzle 313 belongs to block 13, nozzle 209 belongs to block 9, nozzle 105 belongs to block 5, and nozzle 1 belongs to block 1.

FIG. 17 shows combinations of nozzle blocks used for the first 20 rasters of the region A. As described above, six nozzles belonging to different groups, except for the first and sixth scans, are combined. Next is a description of a method for setting the block drive timings Bt for these six nozzles used for printing of the same raster performed in six scans. Also in the present embodiment, different block drive timings Bt are set for each scan, such that when six block drive timings Bt are sorted in ascending order of timings, the timing interval BL between any two of the block drive timings Bt is wide.

What is different from the second embodiment is that, because the block division frequency Nb (=20) is not a submultiple of the feed amount Nf (=104), nozzles belonging to different blocks are used among respective scans. It is, however, noted that nozzles used for the first and sixth scans belong to the same block. It can be seen from the relationship between the block division frequency Nb and the feed amount Nf that the block division frequency and the feed amount coincide with each other once for every five scans. That is, nozzles that belong to the same block are used in cycles of 520 that is the least common multiple of the block division frequency Nb (=20) and the feed amount Nf (=104). Accordingly, in the present embodiment, the block timing interval BL between each scan in the direction of a raster is set to 4 that is the greatest common divisor of the block division frequency Nb (=20) and a remainder Nj (=4) obtained by dividing the feed amount Nf (=104) by the block division frequency Nb (=20). Furthermore, the interval between scans that are performed using nozzles belonging to the same block is set to two that is half the value of the block timing interval BL. Using printing of rasters 0 and 1 as an example, in the case of raster 0, Bt0 is set for the first scan, Bt4 is set for the second scan, Bt8 is set for the third scan, Bt12 is set for the fourth scan, Bt16 is set for the fifth scan, and Bt2 is set for the sixth scan. For printing of raster 1, Bt1 is set for the first scan, Bt5 is set for the second scan, Bt9 is set for the third scan, Bt13 is set for the fourth scan, Bt17 is set for the fifth scan, and Bt3 is set for the sixth scan. Similarly, for all of the other rasters, settings are made so as to satisfy either of the above-described intervals. In this way, even if nozzles that belong to different blocks are used as a result of feed, it is possible to set equal intervals between printed dots for all rasters.

FIG. 18A shows combinations of the block drive timings Bt used for six scans performed on the first 20 rasters. FIG. 18B shows how printed dots are formed on a paper surface in the case where printing is performed with the settings of FIG. 18A and using the mask patterns shown in FIG. 14. As can be seen from FIG. 18B, overlaps of the printed dots are reduced and there are no white patches where ink is not present on the paper surface.

As in the second embodiment, the sequence of the block drive timings Bt is not particularly limited, as long as six combinations of the block drive timings used for six scans satisfy the above-described timing intervals BL. Furthermore, the sequence of combinations of the block drive timings Bt used for respective rasters is also not particularly limited, and it is possible to use optimum combinations.

Now, a generalized method for setting the block drive timings Bt according to the present embodiment will be described. The present embodiment describes the case where the number of passes Np is not a submultiple of the block division frequency Nb and the block division frequency Nb is not a submultiple of the feed amount Nf. In this case, settings are made such that, when Np block drive timings Bt used for Np scans are sorted in ascending order of timings, the timing interval BL between any two of the block drive timings Bt is derived from Equation (3) below.

Timing Interval BL=Greatest Common Divisor of Nj and Block division frequency Nb (where Nj is a remainder of (feed amount Nf/block division frequency Nb)), or $$\text{Timing Interval } BL = BL/2 \tag{3}$$

(where BL is a positive integer)

By setting the block drive timings for each scan so as to satisfy the above-described relationship, it is possible to reduce overlaps of the printed dots and to prevent white patches where ink is not present from occurring on the paper surface. As a result, horizontal streaks in the direction of the raster or unevenness between bands can be reduced.

Although the above has been a description of the embodiments using the case where the timing chart shown in FIG. 2 is applied to the block drive timings Bt, other timing charts such as that shown in FIG. 4 that includes a block margin may be applied to the block drive timings Bt. As mentioned above, an actual printer performs printing with a shift in timing because each column timing interval increases or decreases during scanning of the printhead. Accordingly, the provision of a block margin enables such settings that all the block drive timings are included in all single column timing intervals. In actuality, similar effects will be obtained for both cases where a block margin is provided and where no block margin is provided, because shifts in the intervals of printed dots in a column timing interval are approximately equal.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a print medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-184332, filed Aug. 19, 2010, which is hereby incorporated by reference herein in its entirety.

What is claimed is:

1. An inkjet printing apparatus that prints dot for forming an image on a print medium by scanning, relatively to the print medium, a printhead having a plurality of nozzles forming a nozzle array in a direction intersecting with the nozzle array, such that each raster for forming the image is printed by different nozzles in each of multiple scans, the apparatus comprising:

a drive control unit configured to divide the plurality of nozzles into groups, each including a plurality of adjacent nozzles and control drive of nozzles such that drive timings of nozzles differ among a plurality of blocks in each group, where one block corresponds to one nozzle from each group; and a determination unit configured to determine, for each of the multiple scans, a sequence in which nozzles are driven by the drive control unit, wherein adjacent printed dots are printed by two nozzles and the drive timings of the two nozzles are different from each other, wherein the determination unit determines, for each scan, a sequence in which nozzles among a plurality of blocks are driven, such that each interval distance between the adjacent printed dots is substantially equal in the raster, wherein the each interval distance corresponds to a timing difference of drive timings for printing the adjacent printed dots, and wherein the timing difference corresponds to a number of blocks plus a quotient value of the number of blocks divided by a number of scans.

2. The inkjet printing apparatus according to claim 1, wherein the determination unit determines, for each of the multiple scans, the sequence in which nozzles among the plurality of blocks are driven so that each interval distance is longest of all possible sequences for which each interval distance is substantially equal.

3. The apparatus according to claim 1, wherein the determination unit determines, for each of the multiple scans, an arrangement of dots to be formed by the printhead on the print medium such that adjacent printed dots to be formed by the two nozzles in accordance with a mask pattern for determining a pixel to be printed in one scan so that the adjacent printed dots are printed by the different nozzles.

4. The apparatus according to claim 1, wherein each of the adjacent printed dots is printed in accordance with a drive timing of a nozzle, and wherein a timing interval BL which is a relative timing difference between the drive timings of the adjacent printed dots is calculated by BL=Nb/Np (where Nb is the number of blocks and Np is the number of scans).

5. The apparatus according to claim 1, wherein each of the adjacent printed dots is printed in accordance with a drive timing of a nozzle, and wherein a timing interval BL which is a relative timing difference between the drive timings of the adjacent printed dots is calculated by, in case where Nb is divisible by Np, BL=Nb/Np (where Nb is the number of blocks and Np is the number of scans), and by, in case where Nb is not divisible by Np, BL=(quotient of Nb/Np)+1.

6. A method for controlling drive of nozzles in an inkjet printing apparatus that prints dot for forming an image on a print medium by scanning, relatively to the print medium, a printhead having a plurality of nozzles forming a nozzle array in a direction intersecting with the nozzle array, such that each raster for forming the image is printed by different nozzles in each of multiple scans, the method comprising the steps of:

a drive control step of dividing the plurality of nozzles into groups, each including a plurality of adjacent nozzles and controlling drive of nozzles such that drive timings of nozzles differ among a plurality of blocks in each group, where one block corresponds to one nozzle from each group; and a determination step of determining, for each of the multiple scans, a sequence in which nozzles are driven by the drive control step, wherein the adjacent printed dots are printed by two nozzles and the drive timings of the two nozzles are different from each other, wherein the determination step determines, for each scan, a sequence in which nozzles among the plurality of blocks are driven, such that each interval distance between the adjacent printed dots is substantially equal in the raster, wherein the each interval distance corresponds to a timing difference of drive timings for printing the adjacent printed dots, and wherein the timing difference corresponds to a number of blocks plus a quotient value of the number of blocks divided by a number of scans.

7. The method according to claim 6, wherein the determination step determines, for each of the multiple scans, an arrangement of dots to be formed by the printhead on the print medium such that adjacent printed dots are printed by the two nozzles in accordance with a mask pattern for determining a pixel to be printed in one scan so that the adjacent printed dots are printed by the different nozzles.

8. The method according to claim 6, wherein each of the adjacent printed dots is printed in accordance with a drive timing of a nozzle, and wherein a timing interval BL which is a relative timing difference between the drive timings of the adjacent printed dots is calculated by BL=Nb/Np (where Nb is the number of blocks and Np is the number of scans).

9. The method according to claim 6, wherein each of the adjacent printed dots is printed in accordance with a drive timing of a nozzle, and wherein a timing interval BL which is a relative timing difference between the drive timings of the adjacent printed dots is calculated by, in case where Nb is divisible by Np, BL=Nb/Np (where Nb is the number of blocks and Np is the number of scans), and by, in case where Nb is not divisible by Np, BL=(quotient of Nb/Np)+1.

10. An inkjet printing apparatus that prints each raster on a print medium by moving, relatively to the print medium, a printhead having a plurality of nozzles forming a nozzle array in a direction intersecting with the nozzle array, such that the multiple scans are executed by different nozzles for respectively printing the each raster in multiple scans, the apparatus comprising:

a drive control unit configured to divide the plurality of nozzles into groups, each including a plurality of adjacent nozzles and control drive of nozzles such that drive timings of nozzles differ among a plurality of blocks in each group, where one block corresponds to one nozzle from each group; and a determination unit configured to determine, for each scan, a sequence in which nozzles are driven by the drive control unit, wherein the determination unit determines, for each of the multiple scans, a sequence in which nozzles among a plurality of blocks are driven, such that each interval distance between adjacent printed dots is substantially equal in the raster, wherein the adjacent printed dots are printed by two nozzles, the drive timings of which are different from each other, and wherein the determination unit determines, for each of the multiple scans, the sequence in which nozzles among a plurality of blocks are driven so that the each interval distance is longest of all possible sequences for which the each interval distance is substantially equal.

11. The apparatus according to claim 10, wherein the adjacent printed dots are printed by different nozzles.

12. The apparatus according to claim 11, wherein each of the adjacent printed dots is printed by the printhead in accordance with a mask pattern for determining a pixel to be printed in one scan so that the adjacent printed dots are printed by the different nozzles.

13. The apparatus according to claim 10, wherein each of the adjacent printed dots is printed in accordance with a drive timing of a nozzle, and wherein a timing interval BL which is a relative timing difference between the drive timings of the adjacent printed dots is calculated by BL=Nb/Np (where Nb is the number of blocks and Np is the number of scans).

14. The apparatus according to claim 10, wherein each of the adjacent printed dots is printed in accordance with a drive timing of a nozzle, and wherein a timing interval BL which is a relative timing difference between the drive timings of the adjacent printed dots is calculated by, in case where Nb is divisible by Np, BL=Nb/Np (where Nb is the number of blocks and Np is the number of scans), and by, in case where Nb is not divisible by Np, BL=(quotient of Nb/Np)+1.

* * * * *